US011667433B2

(12) United States Patent
Hoch et al.

(10) Patent No.: US 11,667,433 B2
(45) Date of Patent: Jun. 6, 2023

(54) THREE DIMENSIONAL ARTICLE

(71) Applicant: HOCH BRANDS LLC, Boca Raton, FL (US)

(72) Inventors: Charles V. Hoch, Boca Raton, FL (US); Bruce A. Hoch, Boca Raton, FL (US)

(73) Assignee: Hoch Brands, LLC, Boca Raton, FL (US)

( * ) Notice: Subject to any disclaimer, the term of this patent is extended or adjusted under 35 U.S.C. 154(b) by 0 days.

(21) Appl. No.: 17/503,206

(22) Filed: Oct. 15, 2021

(65) Prior Publication Data

US 2023/0124763 A1 Apr. 20, 2023

Related U.S. Application Data

(60) Provisional application No. 63/256,462, filed on Oct. 15, 2021.

(51) Int. Cl.

| | |
|---|---|
| ***B65D 8/00*** | (2006.01) |
| ***F21V 15/01*** | (2006.01) |
| ***F21V 3/06*** | (2018.01) |
| ***F21V 3/02*** | (2006.01) |

(52) U.S. Cl.

CPC ..... *B65D 15/16* (2013.01); *F21V 3/02* (2013.01); *F21V 3/062* (2018.02); *F21V 15/01* (2013.01); *B65D 2203/00* (2013.01)

(58) Field of Classification Search

CPC ..... B65D 15/16; B65D 2203/00; F21V 3/02; F21V 3/062; F21V 15/01

See application file for complete search history.

(56) References Cited

U.S. PATENT DOCUMENTS

| | | | | |
|---|---|---|---|---|
| 1,277,159 | A | 8/1918 | Walker | |
| 1,934,115 | A | 11/1933 | James | |
| 2,335,786 | A | 11/1943 | Mullica | |
| 4,252,135 | A | 2/1981 | Herman | |
| 5,021,638 | A | 6/1991 | Nopper et al. | |
| 5,040,317 | A * | 8/1991 | Kadjevich | A47G 19/2205 215/13.1 |
| 6,386,387 | B1 * | 5/2002 | Hwang | A47G 19/2288 220/592.17 |

(Continued)

OTHER PUBLICATIONS

Corning Museum of Glass , "Reticello", https://www.youtube.com/watch?v=xCrdewFgObc; (Accessed Jan. 4, 2021), Nov. 23, 2011, 3 pages.

Himalayan Group Inc., "Clear Silicone Hand Water Pipe SL98", http://www.himalayanglass.com/product/clear-silicone-hand-water-pipe-sl-98/, (Accessed Sep. 20, 2019), 7 pages.

(Continued)

*Primary Examiner* — Tsion Tumebo

(74) *Attorney, Agent, or Firm* — Dorsey & Whitney LLP

(57) ABSTRACT

An three dimensional article comprising a main body having an inner body and an outer body overlaying at least a portion of the inner body. At least one of the inner body or the outer body is at least partially visible through the other of the inner body or the outer body. An outer surface of the inner body may include at least one surface feature visible through the outer body. The main body may include a base portion, a medial portion, a neck portion, and a rim portion each of the inner body and outer body defining a base portion, medial portion, neck portion, and a rim portion corresponding to the base portion, medial portion, neck portion, and rim portion of the main body.

17 Claims, 32 Drawing Sheets

(56) References Cited

U.S. PATENT DOCUMENTS

| | | | | |
|---|---|---|---|---|
| 6,390,141 | B1 | 5/2002 | Fisher et al. | |
| 6,516,548 | B2 * | 2/2003 | Lage | G09F 23/08 40/328 |
| 10,408,392 | B2 * | 9/2019 | Yu | F21S 4/10 |
| 10,549,902 | B1 * | 2/2020 | Brown, II | B65D 43/022 |
| 11,058,148 | B2 | 7/2021 | Hoch et al. | |
| 11,231,172 | B1 * | 1/2022 | Wu | F21V 23/002 |
| 2010/0308061 | A1 * | 12/2010 | Loulourgas | B65D 81/3869 220/592.2 |
| 2011/0036363 | A1 | 2/2011 | Urtsev et al. | |
| 2011/0061665 | A1 | 3/2011 | Hylton | |
| 2013/0069089 | A1 * | 3/2013 | Hussell | G02B 6/0003 257/E33.06 |
| 2013/0188333 | A1 * | 7/2013 | Ooya | F21V 9/30 362/84 |
| 2013/0223077 | A1 * | 8/2013 | Kato | F21V 17/101 362/294 |
| 2014/0133144 | A1 * | 5/2014 | Krijn | F21V 23/0485 362/235 |
| 2016/0068295 | A1 * | 3/2016 | Kasha | A47G 7/06 220/4.21 |
| 2016/0230978 | A1 * | 8/2016 | Kato | F21K 9/232 |
| 2018/0283619 | A1 * | 10/2018 | Huang | F21K 9/232 |
| 2019/0072237 | A1 * | 3/2019 | Huang | F21K 9/90 |
| 2019/0307292 | A1 * | 10/2019 | Haas | A47J 41/0077 |
| 2020/0180933 | A1 * | 6/2020 | Paauwe | B67D 1/0437 |
| 2020/0198829 | A1 * | 6/2020 | Rizzo | B29C 49/4252 |
| 2021/0051998 | A1 * | 2/2021 | Hoch | B29C 45/0001 |
| 2021/0068567 | A1 * | 3/2021 | Ganter, I | F21V 33/0036 |
| 2021/0123590 | A1 * | 4/2021 | Huang | F21V 29/50 |
| 2021/0329968 | A1 | 10/2021 | Hoch et al. | |

OTHER PUBLICATIONS

Ooze , "Stack Pipe—Stack Pipe Silicone Bubbler—Orange / Clear", https://www.oozelife.com/products/ooze-stack-pipe-silicone-bubbler-orange-clear, (Accessed Jan. 4, 2021), 5 pages.

Protolabs , "Design Considerations for Overmolding and Insert Molding", https://www.glasspipesla.com/5-Frosted-Clear-Showerhead-Perc-Mini-Silicone-Water-Pipe-w-Clear-Bowl_p_9252.html, (Accessed Sep. 20, 2019), 10 pages.

Puffco , "The Lucid Lightning Peak", https://www.puffco.com/products/the-lucid-lightning-peak, (Accessed Sep. 20, 2019), 11 pages.

Pyptek, "Pyptek Pocket Pipe", https://www.pyptek.com/product/pyptek-pocket/, (Accessed Sep. 20, 2019), 3 pages.

Shenzhen YHS Plastic, Technology Co., Ltd., "Unbreakable Silicone Super Clear Syringe Nectar Dollector", https://yhs-silicone.en.made-in-china.com/product/ivXnprEbugRJ/China-Unbreakable-Silicone-Super-Clear-Syringe-Nectar-Collector.html, (Accessed Sep. 20, 2019), 10 pages.

Smoke Rolla, "3.25" Chillum Pipe Silicone Cover Glass Pipe Color Design", https://wholesale.smokerolla.com/collections/hand-pipes-wholesale/products/3-25-chillum-pipe-silicone-cover-glass-pipe-color-design, (Accessed Sep. 20, 2019), 3 pages.

Twisted Labs , "Fuchsia LED Beaker Silicone Water Pipe", https://www.thetwistedlab.com/product/fuchsia-led-beaker-silicone-water-pipe/, (Accessed Sep. 20, 2019), 3 pages.

Waxmaid , "3" Silicone & Glass Hybrid Blunt Bubbler", https://waxmaidstore.com/collections/water-pipes/products/waxmaid-bubbler, (Accessed Sep. 20, 2019), 3 pages.

Waxmaid , "8.5" Horn Silicone & Glass Hybrid Water Pipe", https://waxmaidstore.com/collections/water-pipes/products/horn-water-pipe, (Accessed Sep. 20, 2019), 3 pages.

Waxmaid , "Waxmaid Nectar Collector", https://waxmaidstore.com/collections/nector-collector, (Accessed Sep. 20, 2019), 2 pages.

* cited by examiner

THREE DIMENSIONAL ARTICLE

CROSS-REFERENCE TO RELATED APPLICATIONS

This application claims the benefit of priority pursuant to 35 U.S.C. § 119(e) of U.S. provisional patent application No. 63/256,462, filed 15 Oct. 2021, entitled "Three Dimensional Article," which is hereby incorporated by reference for all purposes.

BACKGROUND

Glass and other brittle materials are frequently used to create three dimensional articles such as containers like bowls, vases, luminaires, or the like. Creating such articles from glass has certain disadvantages such as the high temperatures needed to mold glass, and the brittleness and fragility of the finished article. It is therefore desirable to create articles with glass-like visual or optical properties using materials that are easier to handle and are more durable and less brittle.

BRIEF SUMMARY

In one embodiment, an three dimensional article includes a main body having an inner body and an outer body overlaying at least a portion of the inner body and defining a first thickness dimension, the main body forming a housing defining an internal compartment having a major dimension and a minor dimension, the minor dimension being less than the major dimension. At least one of the inner body or the outer body is at least partially visible through the other of the inner body or the outer body. The major dimension and the minor dimension are both at least four times greater than the thickness dimension.

Optionally in some embodiments, an outer surface of the inner body includes at least one surface feature visible through the outer body.

Optionally in some embodiments, the main body includes a base portion, a medial portion, a neck portion, and a rim portion each of the inner body and outer body defining a base portion, medial portion, neck portion, and a rim portion corresponding to the base portion, medial portion, neck portion, and rim portion of the main body.

Optionally in some embodiments, the medial portion has a dimension greater than the base portion, the neck portion, and the rim portion of the main body.

Optionally in some embodiments, the inner body includes an inner surface of the inner body and an outer surface of the inner body; and the outer body includes an inner surface of the outer body and an outer surface of the outer body, wherein the outer surface of the inner body and the inner surface of the outer body are joined at an interface.

Optionally in some embodiments, the inner surface of the inner body forms a wall of an internal compartment of the main body.

Optionally in some embodiments, the inner body includes a flange that extends outward from the internal compartment toward the outer body to the outer surface of the outer body to form the rim portion.

Optionally in some embodiments, the outer body includes a flange that extends radially inward from the outer surface of the outer body to the inner surface of the inner body to form the rim portion.

Optionally in some embodiments, the inner body and the outer body include respective upper edges substantially flush with one another to form the rim portion.

Optionally in some embodiments, the at least one surface feature comprises a first surface feature that extends from outer surface of the inner body through the outer body and penetrates the outer surface of the outer body.

Optionally in some embodiments, the first surface feature extends above the outer surface of the outer body.

Optionally in some embodiments, at least one surface feature comprises a second surface feature that extends from the outer surface of the inner body into the outer body to a depth between the inner surface of the outer body and the outer surface of the outer body.

Optionally in some embodiments, a first aperture is defined by the rim and in fluid communication between the internal compartment and the environment.

Optionally in some embodiments, a second aperture is formed in the inner body and the outer body in the base portion, wherein the inner body extends into the second aperture radially inward relative to the outer body to form a lip.

Optionally in some embodiments, the three dimensional article includes a plug including a gland formed on a circumferential face thereof. The second aperture is adapted to receive the plug such that the gland operatively engages with the lip to removably secure the plug to the main body.

Optionally in some embodiments, the outer surface of the inner body is patterned; the inner surface of the outer body conforms to the outer surface of the inner body; and the outer surface of the outer body does not replicate the pattern of the outer surface of the inner body.

Optionally in some embodiments, the pattern includes a plurality of ribs with scallops disposed therebetween, and a thickness of the outer body varies to fill in the scallops such that the outer surface of the outer body is smooth.

Optionally in some embodiments, a combined thickness of the inner body and the outer body is substantially the same at a rib and at a scallop.

An embodiment of a luminaire is disclosed. The luminaire includes: a light source; and a main body having an inner body and an outer body overlaying at least a portion of the inner body and defining a first thickness dimension, the main body forming a housing defining an internal compartment having a major dimension and a minor dimension, the minor dimension being less than the major dimension. At least one of the inner body or the outer body is at least partially visible through the other of the inner body or the outer body. The major dimension and the minor dimension are both at least four times greater than the thickness dimension.

Optionally in some embodiments, an outer surface of the inner body includes at least one surface feature visible through the outer body.

Optionally in some embodiments, the light source is one of a light emitting diode or an incandescent lamp.

Optionally in some embodiments, the main body includes a base portion, a medial portion, a neck portion, and a rim portion each of the inner body and outer body defining a base portion, medial portion, neck portion, and rim portion corresponding to the base portion, medial portion, neck portion, and rim portion of the main body.

Optionally in some embodiments, the article includes a first aperture defined by the rim portion and in fluid communication between the internal compartment and the environment; and a second aperture formed in the inner body and the outer body in the base portion, wherein the inner body extends into the second aperture radially inward relative to the outer body to form a lip.

Optionally in some embodiments, the article includes a plug including a gland formed on a circumferential face thereof, wherein the second aperture is adapted to receive the plug such that the gland operatively engages with the lip to removably secure the plug to the main body.

Optionally in some embodiments, the light source is operatively coupled to the plug.

Optionally in some embodiments, the outer body includes a lattice defining a plurality of apertures that form a divided light effect for light emitted by the light source.

An embodiment of a chandelier is disclosed including at least one of a luminaires as disclosed herein. The chandelier includes a conductor operative to supply electrical power to the luminaire and suspend the luminaire; a lateral support coupled to the conductor; and a flexible element coupled to the lateral support, wherein the flexible element is couplable to ceiling to suspend the chandelier.

An embodiment of a container is disclosed. The container includes a main body having an inner body and an outer body overlaying at least a portion of the inner body and defining a first thickness dimension, the main body forming a housing defining an internal compartment having a major dimension and a minor dimension, the minor dimension being less than the major dimension. At least one of the inner body or the outer body is at least partially visible through the other of the inner body or the outer body, and the main body includes a base portion, a medial portion, a rim portion. The major dimension and the minor dimension are both at least four times greater than the thickness dimension.

Optionally in some embodiments, the rim portion is broader than the medial or base portions.

Optionally in some embodiments, the rim portion has a same dimension as the medial and base portions.

BRIEF DESCRIPTION OF THE SEVERAL VIEWS OF THE DRAWINGS

FIG. 5A FIG. 4A is a perspective view of an embodiment of a three dimensional article.

DETAILED DESCRIPTION

Figure 1A:
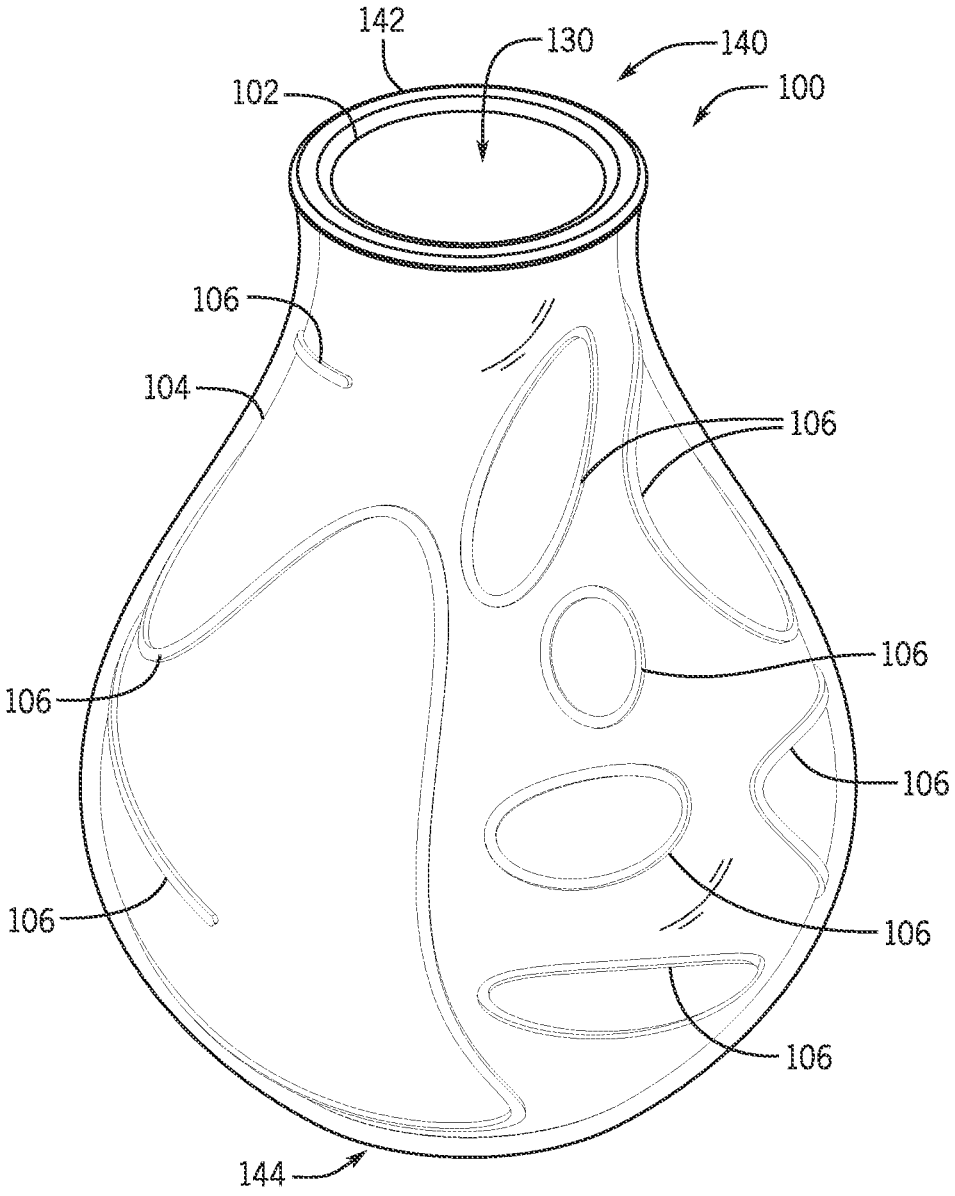
FIG. 1A is a perspective view of an embodiment of a three dimensional article.

The following description generally relates to a three dimensional article, apparatus, or device generally formed of a main body having an inner body and an outer body. The inner body and the outer body together define a first thickness dimension, and form a housing defining an internal compartment having a major dimension and a minor dimension, the minor dimension being less than the major dimension. The major dimension and the minor dimension are both greater than the thickness dimension. In various embodiments, the major dimension and the minor dimension may be at least two, three, four, five, six or more times greater than the thickness dimension. The three dimensional articles may form a variety of objects including, but not limited to: decorative articles, lamps, containers, pendant lights, chandeliers, bowls, pots, cups, or the like. The outer body overlays all or a portion of the inner body. In many embodiments, the outer body is transparent or partially transparent so that the inner body may be viewed through the outer body. Alternately, in some embodiments, the inner body is transparent or partially transparent and the outer body includes a window, slit, or other aperture to reveal the inner body through the outer body. Where the outer body or the inner body is sufficiently transparent, a portion of the article may appear to be a glass-like substance. The appearance of glass used on this type of device is unique, counter-intuitive, and unusual. Additionally, the transparent or partially transparent outer body allows relief features, if any, that are positioned on the outer surface of the inner body to affect the appearance and/or function/effectiveness of the article, and may be readily seen and appreciated.

The inner body and/or outer body may define an internal compartment. The internal compartment may be open to the environment outside of the outer body. The internal compartment may be selectively closable from the environment with a closure such as a cap or plug. The internal compartment may be suitable to contain a fluid such as air or water. The internal compartment may receive all, or a portion of a light source such as an incandescent lamp, light emitting diode ("LED") or the like, and/or a portion of a power supply for such light source. In such articles, either the inner body or the outer body may be sufficiently transparent to allow light to be transmitted from the light source through the fluid in the internal compartment, through all or portions of the inner and/or outer bodies. The inner and/or outer bodies may have a color, feature, aperture, pattern, varying opacity, texture, thickness, etc. that alter or affect the quality (e.g., hue, brightness, pattern, direction) of light emitted by the light source to generate an aesthetic and/or functional light emission from the article.

The outer body of the articles described herein at least partially covers the inner body. In some examples, the outer body of the article may include a layer of an at least partially transparent flexible or resilient material, such as for example, silicone rubber, formed over the inner body. In some examples, the inner body may have a relief or surface feature or features visible through the outer body. In some examples, the article may be formed using a technique commonly known as over-molding or insert-molding. In one example, where the outer body is formed of transparent silicone rubber the disclosed apparatus and/or method may provide an advantage in contrast to articles made of other materials because while it looks like it is made of glass, the flexible outer body is able to withstand somewhat rough handling, such as that when the apparatus may be used, accidentally dropped, and/or otherwise handled.

Referring to FIG. 1A through FIG. 1E a three dimensional article 100 is shown including a main body 140 with an inner body 102 and an outer body 104. The outer body 104 overlays at least a portion of the inner body 102. The inner body 102 and outer body 104 may be thin shells that define the main body 140. As shown for example in FIG. 1C, the inner body 102 and the outer body 104 may together have define a thickness dimension $T_1$. The main body 140 may form a housing with an internal compartment 108. The internal compartment 108 may have a major dimension 103, such as for example as measured across the largest diameter of the internal compartment located in the medial portion of the main body, and a minor dimension 101, such as for example as measured across the smallest diameter of the internal compartment located at the neck portion. In one example the minor dimension 101 is less than the major dimension 103. While the major dimension 103 and the minor dimension 101 shown for example in FIG. 1C may be diameters of different regions or portions of the internal compartment 108, the major and minor dimensions may be measured between different portions of the internal compartment 108. For example, a major dimension 103 may be defined by a distance between the sidewalls of an entire internal compartment 108, or may be defined by a distance between the sidewalls of a portion of an internal compartment 108. Where there are more than one internal compartment 108, such as in the embodiment shown in FIGS. 12A and B, the major 103 and minor 101 dimensions may be taken in different portions of the internal compartment 108, such as in the central body and within an arm. The major 103 and minor 101 dimensions may be parallel to one another, orthogonal to one another, or angled relative to one another. In various embodiments, the major dimension 103, the minor dimension 101, or both the major dimension 103 and the minor dimension 101 may be at least two, three, four, five, six or more times greater than the thickness dimension $T_1$. The internal compartment 108 in many embodiments is suitable to contain a fluid such as air or water, or devices such as light sources and/or power supplies for light sources. An inner surface of the inner body 122 may form a wall of the internal compartment 108. An outer surface of the inner body 124 may be in contact with at least a portion of an inner surface of the outer body 126. The inner body 102 and outer body 104 may be integrally formed with one another to form the main body 140. Alternatively, the outer body may be formed about the inner body 102. In some embodiments, the outer surface of the inner body 124 and the inner surface of the outer body 126 may be adhered to one another at an interface 120, such as by overmolding, an adhesive, blow molding, a physical fit of the inner body 102 in outer body 104, or the like. In some embodiments, the inner body 102 and/or outer body 104 may be formed of two or more pieces that are joined to one another such as by welding, an adhesive, brazing, or the like. For example, the inner body 102 may be formed of two halves that are joined with an adhesive. The outer body 104 may be formed of two halves that are joined with each other and with the inner body 102, such as with an adhesive, melting, welding, or the like.

The outer body 104 may have an outer surface of the outer body 128 that defines an outer surface of the main body 140. The inner body 102 includes one or more surface features 106 that provide functional or aesthetic features of the three dimensional article 100. In embodiments where the outer body 104 is at least partially transparent, the surface features 106 may be at least partially visible through the outer body 104, giving the surface features 106 the appearance of being captured under glass.

The outer body 104 overlays at least a portion of the inner body 102. The outer body 104 may be sufficiently transparent, including transparent, partially transparent, translucent, or partially translucent, to view at least a portion of the inner body 102, and associated relief or surface features if any, therethrough. The outer body 104 may be made of silicone rubber, for example including compression molded, platinum cured silicone rubber. Examples of a silicone rubber that may be at least partially transparent include 100% optically clear liquid silicone rubber, clouded clear compression molded silicone rubber, hardened silicone and heat-cured rubber (HCR) silicone. The outer body 104 may have different transparency levels overlaying different parts of the inner body 102. This may improve the appearance of the article, or may emphasize various feature elements of the article. For instance, the transparency level of the inner body 102 extending over the upper edge 110 of the outer body 104 may be lower than the transparency level of the outer body 104. The inner body 102 may also be made of silicone rubber, or may also be made of materials that provide some level of rigidity or stiffness, including plastic, metal, glass, ceramic, biological materials (e.g., wood, fiber, flowers, vegetative matter, vines, or the like), stone, mineral, composites, or the like. The nominal thickness Tn of the outer body 104 and/or inner body 102 may be a layer of between 1 mm to 3 centimeters thick, or more or less, depending on the application. A nominal thickness of 0.5 cm may be considered acceptable. The largest nominal cross sectional dimension (such as that of FIG. 1C) of the inner body 102 may range from or more or less depending on the application. This largest nominal cross sectional dimension may not include the measurement of protruding feature elements, if any. These example characteristics of the type of material of the outer body 104 and the inner body 102, as well as the thickness of the outer body 104, and/or inner body 102 generally apply to the various embodiments described throughout unless otherwise stated.

Figure 1C:
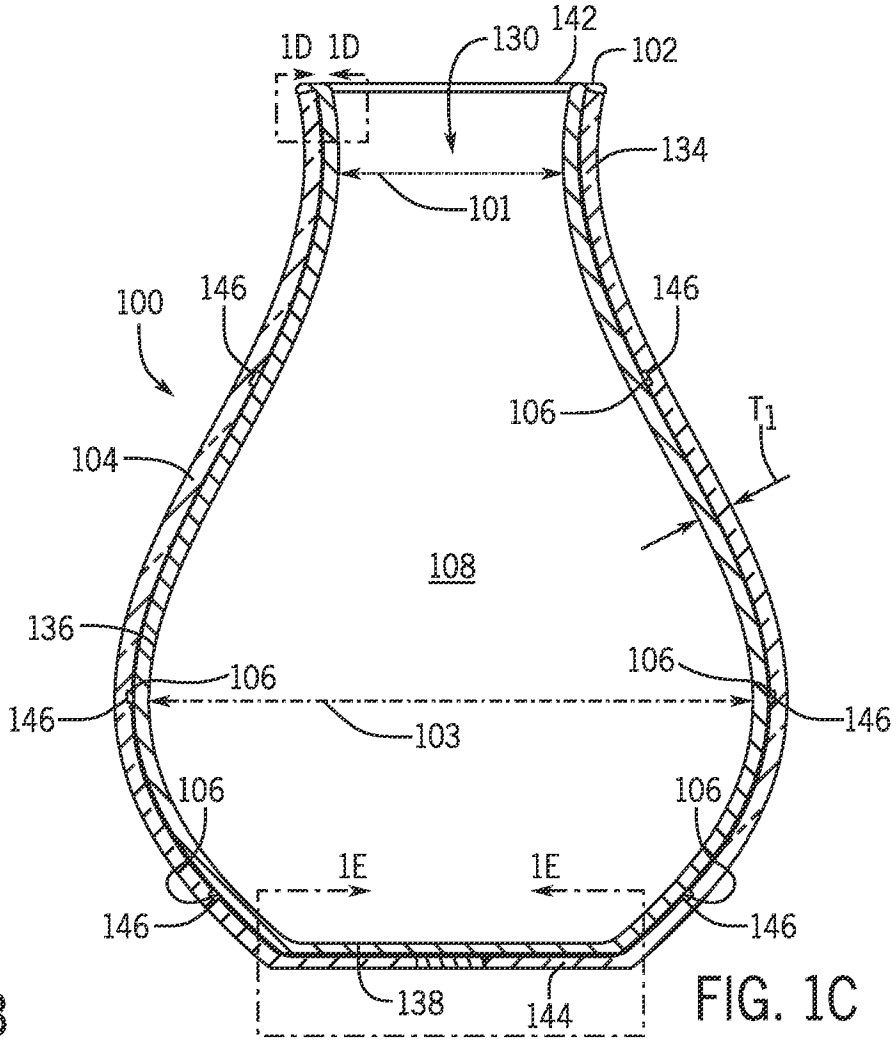
FIG. 1C is a section view of the three dimensional article of FIG. 1A taken along section line 1C-1C of FIG. 1B.
Figure 1B:
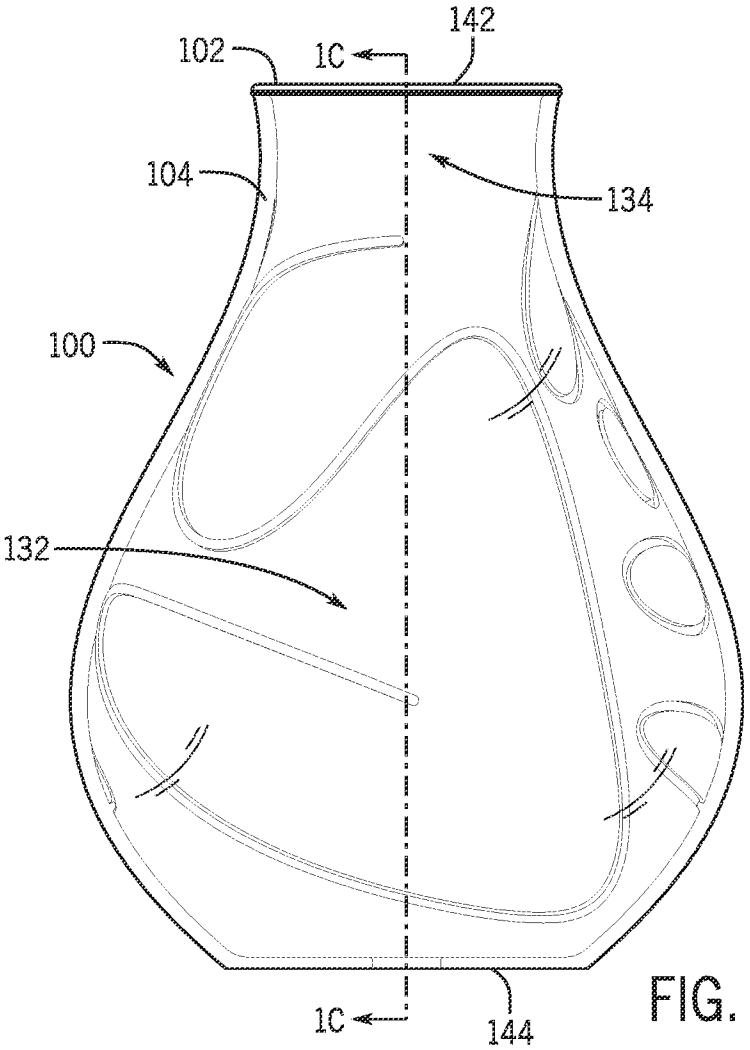
FIG. 1B is a side elevation view of the three dimensional article of FIG. 1A.

The main body 140 has a base 144 and a rim 142 opposite the base 144. As best shown in FIGS. 1A-1C, between the base 144 and the rim 142, the main body 140 has a medial portion 132 and a neck portion 134. Beginning at the base 144, the width of the main body 140 may become gradually wider in the medial portion 132 as the main body 140 extends toward the rim 142. The medial portion 132 may reach a widest point partially between the base 144 and the neck portion 134. The medial portion 132 may taper from the widest point to a narrower width as the main body 140 extends further toward the rim 142. For example, the medial portion 132 may be a rounded spherical, oblong, ovoid, teardrop, cubical, parallelepiped, prismatic, or other shape that gradually tapers to the neck portion 134 in one direction and tapers to the base 144 in an opposite direction. In other embodiments, the medial portion 132 may include sharp or abrupt transitions to the neck portion 134 and/or base 144. In other embodiments, the medial portion 132 may not taper and may maintain a substantially constant dimension between the base and the rim 142 (see, e.g., FIG. 9A-FIG. 9D). The shape of the cross section of the internal compartment 108 may vary with the transition of the main body 140 between the base 144, through the medial portion 132, then neck portion 134, and the rim 142. The neck portion 134 may be narrower than the medial portion 132. The main body 140 may have substantially circular cross sections in planes aligned with and offset from the base 144 or the rim 142. The rim 142 may define an aperture 130 that fluidically connects the internal compartment 108 with the environment outside the three dimensional article 100. The inner surface of the inner body 122 may form a face 138 that forms a floor of the internal compartment 108. In some embodiments, the inner surface of the inner body 122 may form a non-planar floor, such as curved, textured, or the like. Other articles disclosed herein may have other shaped portions that provide functional or aesthetic aspects of the article. The cross section of the main body 102 may have other shapes, such as other geometric shapes, non-geometric shapes, or a combination. The cross sectional shape may vary along the length of the main body 102.

Surface features 106 may also be suspended in the outer body 104, and may or may not be combined with a surface feature 106 positioned on the inner body 102. Such suspended a surface feature 106 may include metallic flakes, fluorescent pigments, or other visually interesting elements. The surface features 106 suspended in the outer body 104 may be concentrated in the layer thickness of the outer body 104 to be spaced away from the outer surface of the outer body 128. This may reduce or minimize the occurrence of the suspended surface features 106 from being separated from the outer body 104 caused by friction of use over time. For example, the suspended surface features 106 may be concentrated in the lower ¼ of the nominal thickness Tn of the outer body 104 closest to the inner body 102. Alternatively or additionally, suspended surface features 106 may be concentrated in the middle region, such as for example the middle third, of the nominal thickness Tn of the outer body 104. Alternatively or additionally, the suspended surface features 106 may be positioned in any region.

Examples of a surface feature 106 are shown in FIG. 1A. In this example, the surface feature 106 is an elongated surface feature, which may protrude from the outer surface of the inner body 124. The surface feature 106 may protrude along its entire length, or may protrude along only part or parts of its length. The surface feature 106 may extend from the outer surface of the inner body 124 into the outer body 104 to a depth between the inner surface of the outer body 126 and the outer surface of the outer body 128. The parts that do not protrude may be surface features that are flush with the outer surface of the outer body 128, or may be absent, or may be formed as a recess in the outer surface of the inner body 124. The elongated surface feature 106 may extend along a portion of or entirely along the length of the inner body 102, such as for example along at least part of the neck portion 134, the medial portion 132, or the base 144. In some embodiments, the surface feature 106 may have the form of a curve, line, circle, oval, polygon, or irregular shape. A surface feature 106 may protrude from the outer surface of the inner body 124. A second surface feature 106 may be positioned on an opposite side of the main body 140 from the first surface feature 106. Either the first and/or the second surface features 106 may extend in a non-linear manner, such as to form a thin, elongated shape with at least one curved portion. The thin elongated shape may have several curved portions, and may include a combination of straight and curved portions. Some surface features may form closed shapes such as circles, other polygons or irregular shapes.

The surface features 106 on the inner body 102 may be applied to the outer surface of the inner body 124. In one example, the surface features 106 may each or both be adhered to the outer surface of the main body with adhesive or other types of bonding. The surface features 106 may each or both be molded onto the outer surface of the inner body 124, such as by co-molding. The surface features 106 may each or both be formed in the surface of the inner body 102, such as when the inner body 102 itself is molded, and be integral therewith.

The surface features 106 may protrude from the outer surface of the inner body 124 to a height of $1/5^{th}$ of the actual thickness or the nominal thickness of the outer body 104. Again, the nominal thickness of the outer body 104 may be defined as the thickness of the outer body 104 overlying the outer surface of the inner body 124 where there is no surface feature. The surface feature may protrude to a height of ⅞ths or more of the actual thickness of the outer body 104 or the nominal thickness of the outer body 104. The surface feature may cause a corresponding relief shape in the outer surface of the outer body 128. Depending on the thickness of the outer body 104 overlying the surface feature or features, the outer surface of the outer body 128 may not form a relief shape, or may form a significant relief shape. Where no relief shape is created, the surface feature or surface features 106 may provide a primarily aesthetic effect. Where a relief shape is formed, the surface feature or surface features 106 may additionally provide a functional enhancement, such as increased friction, caused by the change in the local height in the outer surface of the outer body 128 such as to grasp the three dimensional article 100.

The surface features 106 may protrude through the outer surface of the outer body 128 to be flush with the nominal thickness of the outer body 104 or to extend above the outer surface of the outer body 128. This protrusion through the outer surface of the outer body 104 is described in greater detail below with respect to the three dimensional article 400 shown for example in FIGS. 4A and 4B.

In general structural and/or aesthetic features may be positioned on the outer surface of the inner body 124, which may be overlaid by the outer body 104. Because the outer body 104 may be at least semi-transparent as described above, the structural and/or aesthetic features may enhance the appearance of the three dimensional article 100, or may provide functional benefits in the use of the article. The structural and/or aesthetic features, referred to as surface features 106, may include a protrusion from the inner body, grooves or recesses in the inner body, graphics, colors, pictures, or other aspects that affect the appearance of the inner body. In one example, the surface features 106 may include structures that protrude outwardly away from the outer surface of the inner body 124. The surface feature 106 may protrude up to and through the outer surface of the outer body 128. The surface features 106 may also protrude inwardly into the outer surface of the inner body 124, forming grooves or recesses. These surface features 106 may be structures integrally formed of the outer surface of the inner body 124, or may be separate material or structures added to, secured to, attached to, or integrated with, the inner body 102, such as by molding or other securement, adhesion or bonding methods. The surface features 106 may also be structures that are inlaid into the surface but are flush with the outer surface of the inner body 124. The surface features 106 may be attached to the outer surface of the inner body 124, or may be seated and/or anchored in recesses formed in the outer surface of the inner body 124. The surface features 106, where they are separate material or structures positioned on the inner body 102, may be made of natural or man-made materials, including plastic, rubber, metal, wood, or composites. They may be rigid, flexible, reflective, ultraviolet luminescent, absorptive, or have other characteristics.

The outer body 104 may overlay the surface features 106. The surface features may cause a corresponding shape or relief contour to be formed in the outer surface of the outer body 128, such as for example when the thickness of the outer body 104 over the surface feature 106 is the same as, similar to, or greater than the thickness of the outer body 104 over the outer surface of the inner body 124 without a surface feature 106. The surface features 106 may not cause a corresponding or similar resultant shape to be formed in the outer surface of the outer body 128 (see, e.g., FIG. 5A-FIG. 5E), such as for example when the thickness of the outer body 104 over the surface features 106 is less than the thickness of the outer body 104 over the outer surface of the inner body 124 without a surface feature 106.

The example shown in FIG. 1C shows at least one surface feature 106 extending along part of the inner body 102. The at least one surface feature 106 may be positioned in a corresponding recess 146 formed in the outer surface of the inner body 124. The recess 146 is formed in the size and shape as desired, such as for this example as an elongated, narrow shaped groove extending continuously in a non-linear path from near base 144, along the medial portion 132, and the neck portion 134 (see, e.g., FIG. 1B). The material that makes the surface feature 106 is received in the recess 146, and may be flush with the outer surface of the outer body 128. The outer body 104 of the main body 140 overlies the surface feature 106, and in this example the surface feature 106 does not result in a relief shape on the outer surface of the outer body 128.

The outer surface of the outer body 128, as shown in this example, may have a shape that at least partially conforms to and replicates the shape of the inner body 102. As shown, for example, the outer body 104 replicates the shape of the inner body 102 along the neck portion 134, the medial portion 132, and the base 144. In some examples, the outer surface of the outer body 128 may however define a shape that does not conform to the shape of the inner body 102, and instead may have a shape different than the shape of the inner body 102. For one example, the outer surface of the outer body 128 may form a circular cross section while the outer surface of the inner body 124 may form a non-circular cross section, such as for example a square, polygonal, or irregular cross section.

Figure 1D:
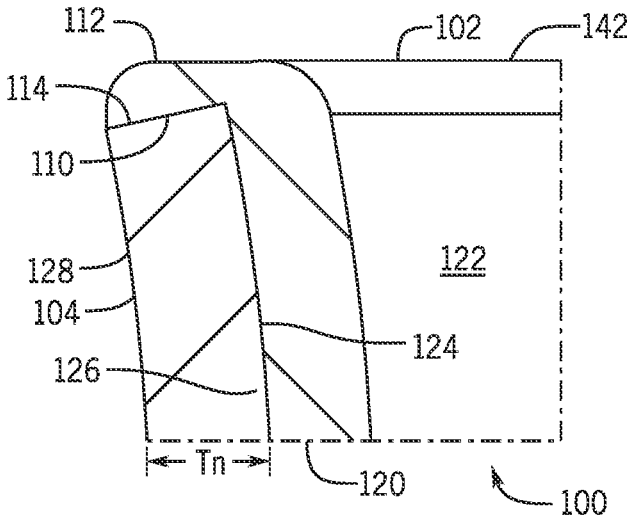
FIG. 1D is a partial detail view of a rim portion of the three dimensional article of FIG. 1A taken at line 1D-1D of FIG. 1C.

As best shown in FIG. 1D, the rim 142 may be formed by a feature of the inner body 102 and a feature of the outer body 104. For example, the inner body 102 may include a flange 112 that extends outward from the internal compartment 108 toward the outer body 104. The flange 112 may extend to, or in some cases beyond, the outer surface of the outer body 128. The flange 112 may form a shoulder 114. The outer body 104 may have an upper edge 110 opposite the base 144. The upper edge 110 may abut the shoulder 114. For example, the shoulder 114 may form a stop or locating feature for the outer body 104. The upper edge 110 may be adhered to the shoulder 114 in some embodiments. Such a rim 142 structure may enhance the stiffness, rigidity, and/or strength of the three dimensional article 100 in the region near the rim 142. For example, the rim 142 may help hold the aperture 130 open either when un-influenced by outside forces and/or when such forces are applied.

Figure 1E:
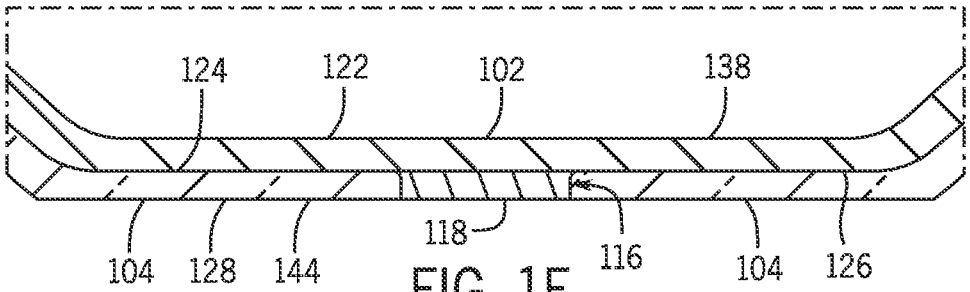
FIG. 1E is a partial detail view of a rim portion of the three dimensional article of FIG. 1A taken at line 1E-1E of FIG. 1C.

As shown for example in FIG. 1E, the base 144 may include an aperture 116 formed in a portion of the outer body 104. The aperture 116 may be adapted to provide fluid communication between the internal compartment 108 and the environment. The aperture 116 may be adapted to removably receive a plug 118. The plug may selectively sever the fluid communication between the internal compartment 108 and the environment when installed and may selectively establish fluid communication between the internal compartment 108 and the environment when removed. In some embodiments, the aperture 116 extends through the outer body 104 between the inner surface of the outer body 126 and the outer surface of the outer body 128. When installed in the aperture 116, the plug 118 may form a substantially planar or flush face of the base 144. In some embodiments, the aperture 116 extends through the inner body 102 between the inner surface of the inner body 122 and the outer surface of the inner body 124. In such embodiments when the plug 118 is installed in the aperture 116, the plug 118 may be substantially flush with the face 138. In some embodiments, the aperture 116 extends through both the inner body 102 and the outer body 104. In such embodiments, the plug 118 may extend through all or a portion of either or both of the inner body 102 and the outer body 104. For example, the plug 118 may be substantially flush with the face 138 at the top of the plug 118 and substantially flush with the base 144 at the bottom of the plug 118. In some embodiments the plug 118 is integrally formed with, or affixed to, the inner body 102 or the outer body 104. In such embodiments the plug 118 may help locate the inner body 102 and the outer body 104 relative to one another. For example, when the plug 118 is integrally formed with, or affixed to, the inner body 102, the plug 118 may be received in the aperture 116 and may thus locate the inner body 102 relative to the outer body 104. Similarly, when the plug 118 is integrally formed with, or affixed to, the outer body 104, the plug 118 may be received in the aperture 116 formed in the inner body 102 and may help locate or align the inner body 102 with the outer body 104. In some embodiments, the plug 118 may be optional, such as if the three dimensional article 100 is to be used as a flower pot, to provide drainage from the roots of a plant in the three dimensional article 100.

With reference to FIGS. 2A-2D, an embodiment of a three dimensional article 200 is shown. The three dimensional article 200 may be substantially similar to the three dimensional article 100 as previously described. The three dimensional article 200 may have a different structure to form a rim 216 than the three dimensional article 100. The rim 216 may have a similar function as the rim 142. The rim 216 may be formed by a feature of the inner body 102 and a feature of the outer body 104. The outer body 104 may include a flange 222 that extends radially inward from the outer surface of the outer body 128 to, and in some embodiments over, the inner surface of the inner body 122. The flange 222 may form a shoulder 220. The inner body 102 may have an upper edge 218 opposite the base 144. The upper edge 218 may abut the shoulder 220. For example, the shoulder 220 may form a stop or locating feature for the inner body 102. The upper edge 218 may be adhered to the shoulder 220 in some embodiments. Such a rim 216 structure may enhance the stiffness, rigidity, and/or strength of the three dimensional article 200 in the region near the rim 216. For example, the rim 216 may help hold the aperture 130 open either when un-influenced by outside forces and/or when such forces are applied.

Figure 2A:
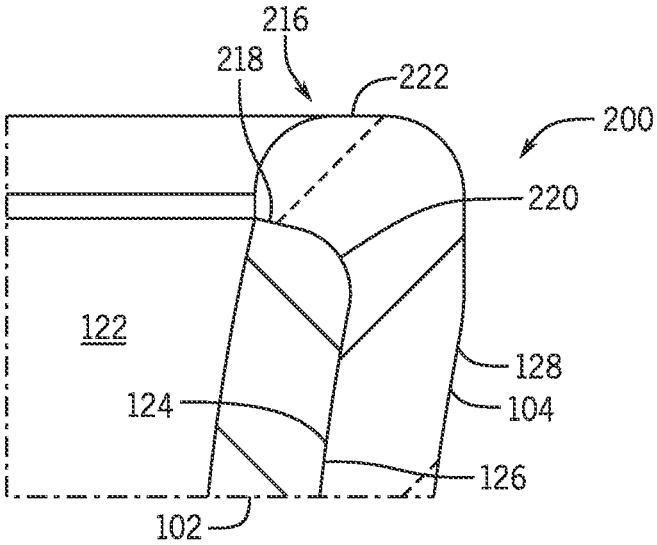
FIG. 2A is a partial detail view of a rim portion of the three dimensional article of FIG. 2B taken at line 2A-2A of FIG. 2B.
Figure 2B:
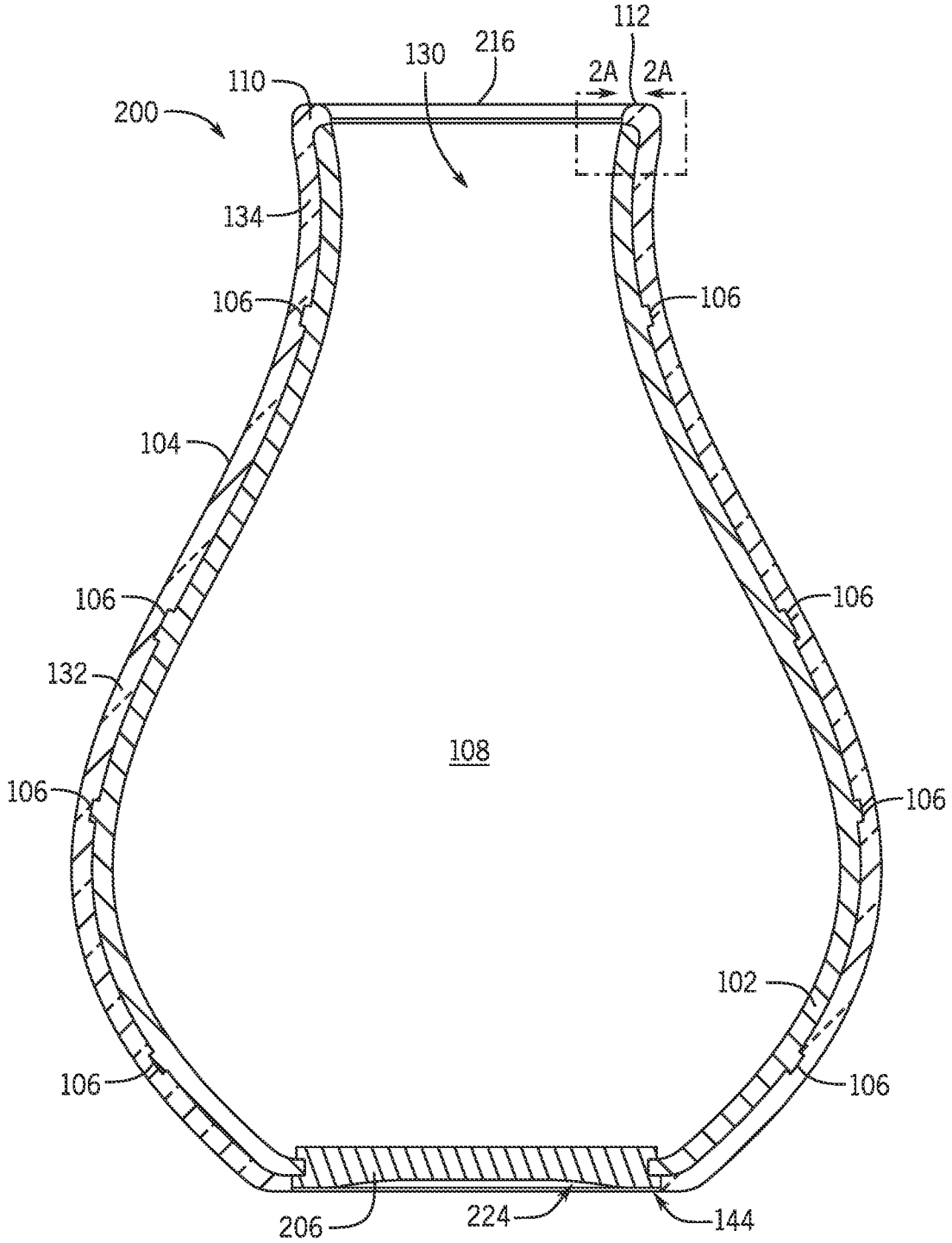
FIG. 2B is a section view of a three dimensional article.
Figure 2C:
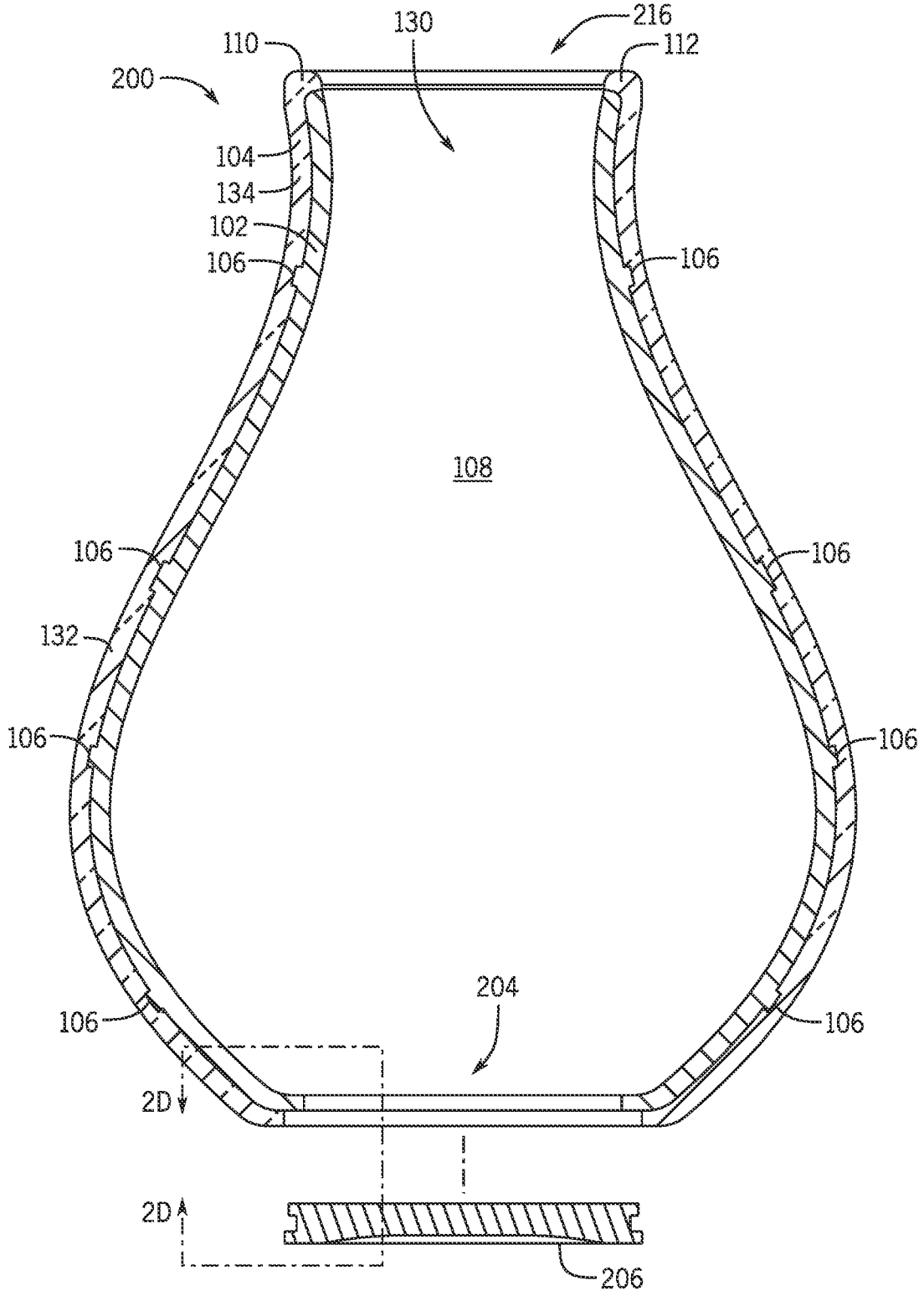
FIG. 2C is a partially exploded view of the three dimensional article of FIG. 2B.
Figure 2D:
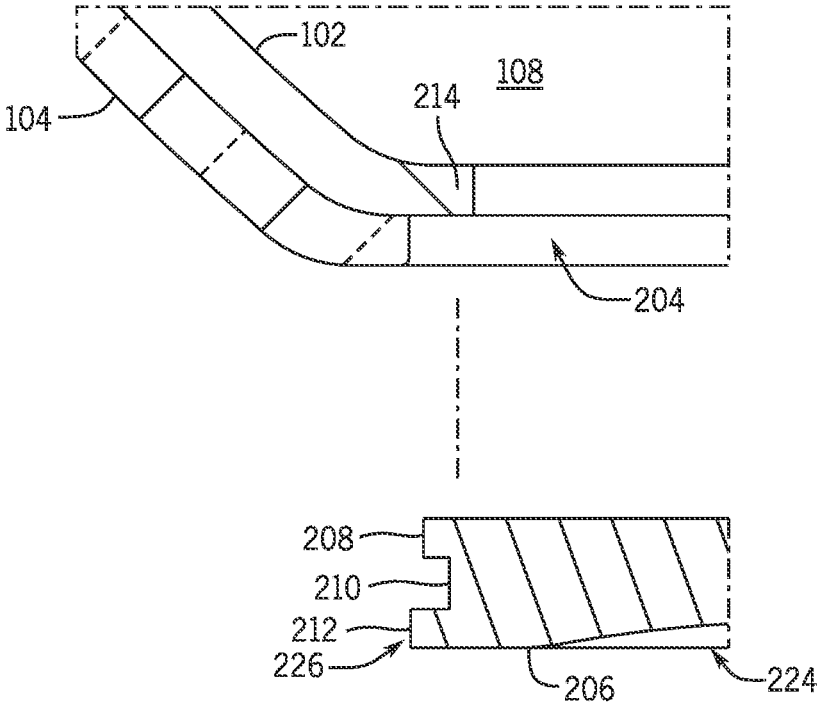
FIG. 2D is a partial detail view of a base portion of the three dimensional article of FIG. 2B taken at line 2D-2D of FIG. 2C.

As shown for example in FIG. 2B through 2E, the three dimensional article 200 may have an aperture 204 formed in the inner body 102 and the outer body 104. The aperture 204 may be adapted to receive a removable element or plug 206. The plug 206 may have a disc-like main body 232 with an upper face 228, a lower face 230 offset from the upper face 228, and a circumferential face 226 between the upper face 228 and the lower face 230. The aperture 204 may provide selective fluid communication between the internal compartment 108 and the environment similar to the aperture 116 previously described. As best shown in FIG. 2B, the plug 206 may be of sufficient thickness to sit substantially flush with one or both of the face 138 and/or base 144 when received in the aperture 204. In some embodiments, the lower face 230 of the plug 206 may include a recess 224 formed therein. As best shown in FIG. 2D, a circumferential face 226 of the plug 206 may have a groove or gland 210 formed therein. The gland 210 may extend from the circumferential face 226 toward the middle of the plug 206. The gland 210 may be formed at least part way between the upper face 228 and the lower face 230. Thus, the gland 210 may form an upper flange 208 and a lower flange 212. The inner body 102 may extend in the aperture 204 radially inward relative to the outer body 104 and form a lip 214. When the plug 206 is received in the aperture 204, the lip 214 may be received in the gland 210, between the upper flange 208 and the lower flange 212. When installed in the aperture 204, the lower flange 212 may abut the outer body 104, the lip 214 may abut the gland 210, and the upper flange 208 may sit atop the face 138. The gland 210 and the lip 214 may operatively engage with one another to removably secure the plug 206 to the main body 140. The 206 provides functional and/or aesthetic benefits to the three dimensional articles as described in further detail herein.

Figure 3:
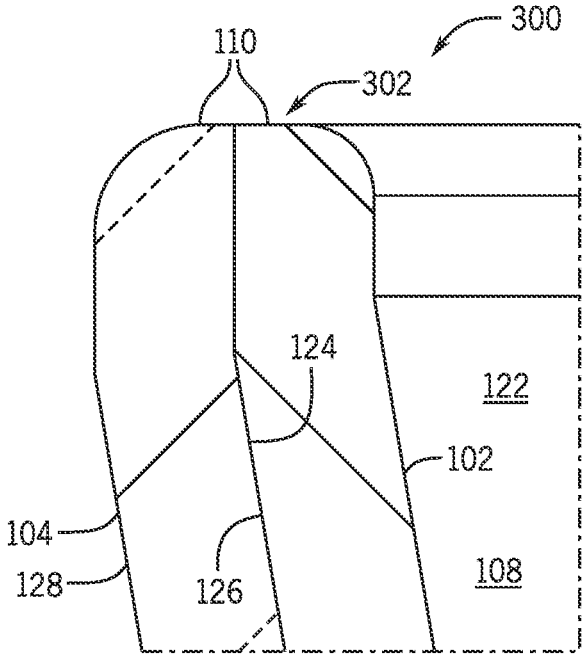
FIG. 3 illustrates an embodiment of a rim portion suitable for use with any three dimensional article disclosed herein.

FIG. 3 shows an example of a three dimensional article 300 with a rim 302 where the inner body 102 and the outer body 104 include upper edges 110 that are substantially flush with one another. The three dimensional article 300 may be substantially similar to the three dimensional article 100 and the three dimensional article 200, or any other three dimensional article disclosed herein except for the details of the rim 302. For example, the three dimensional article 300 may have a base, a medial portion, and/or a neck portion. The rim 302 is suitable for use with any three dimensional article disclosed herein.

Figure 4A:
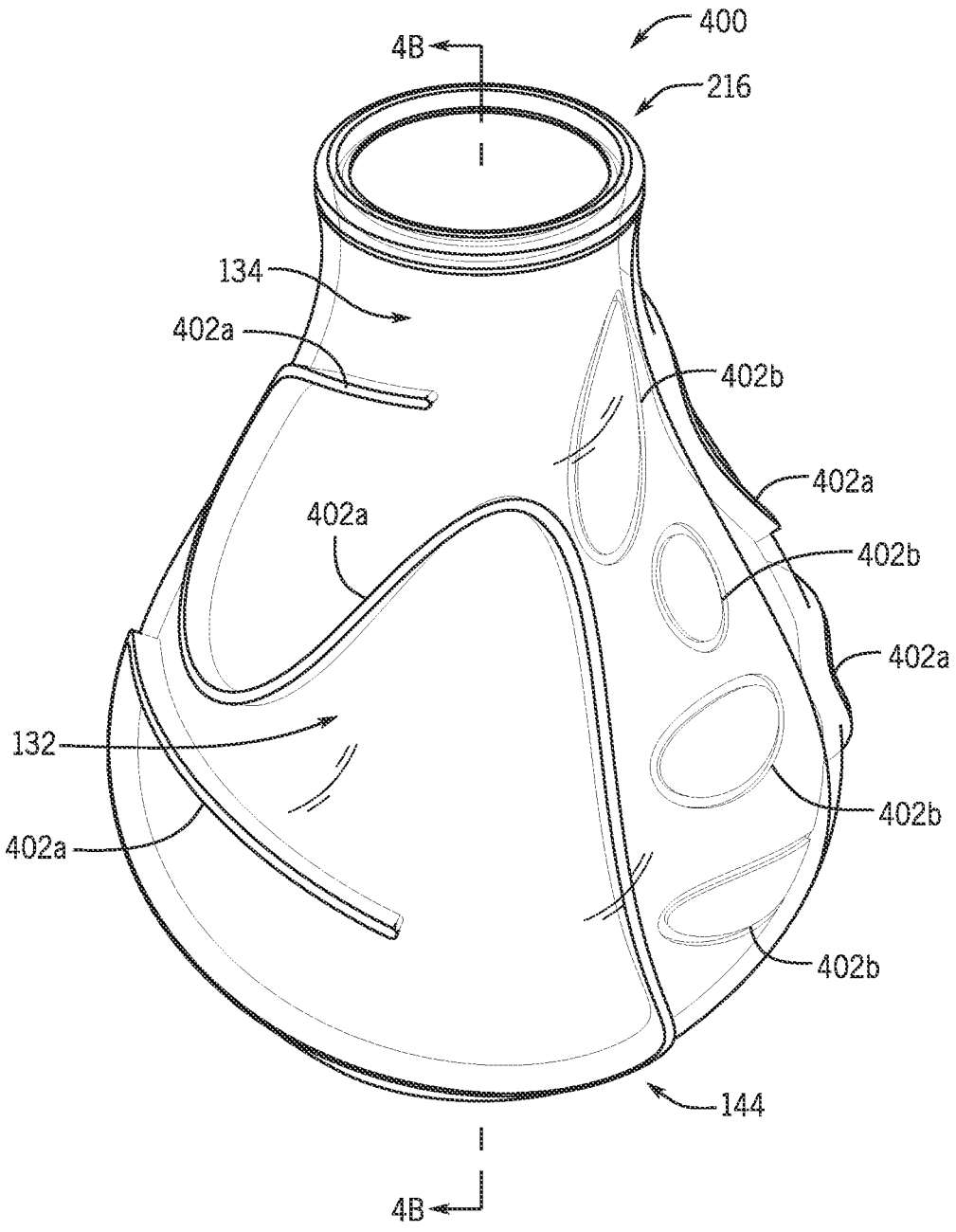
FIG. 4A is a perspective view of an embodiment of a three dimensional article.
Figure 4B:
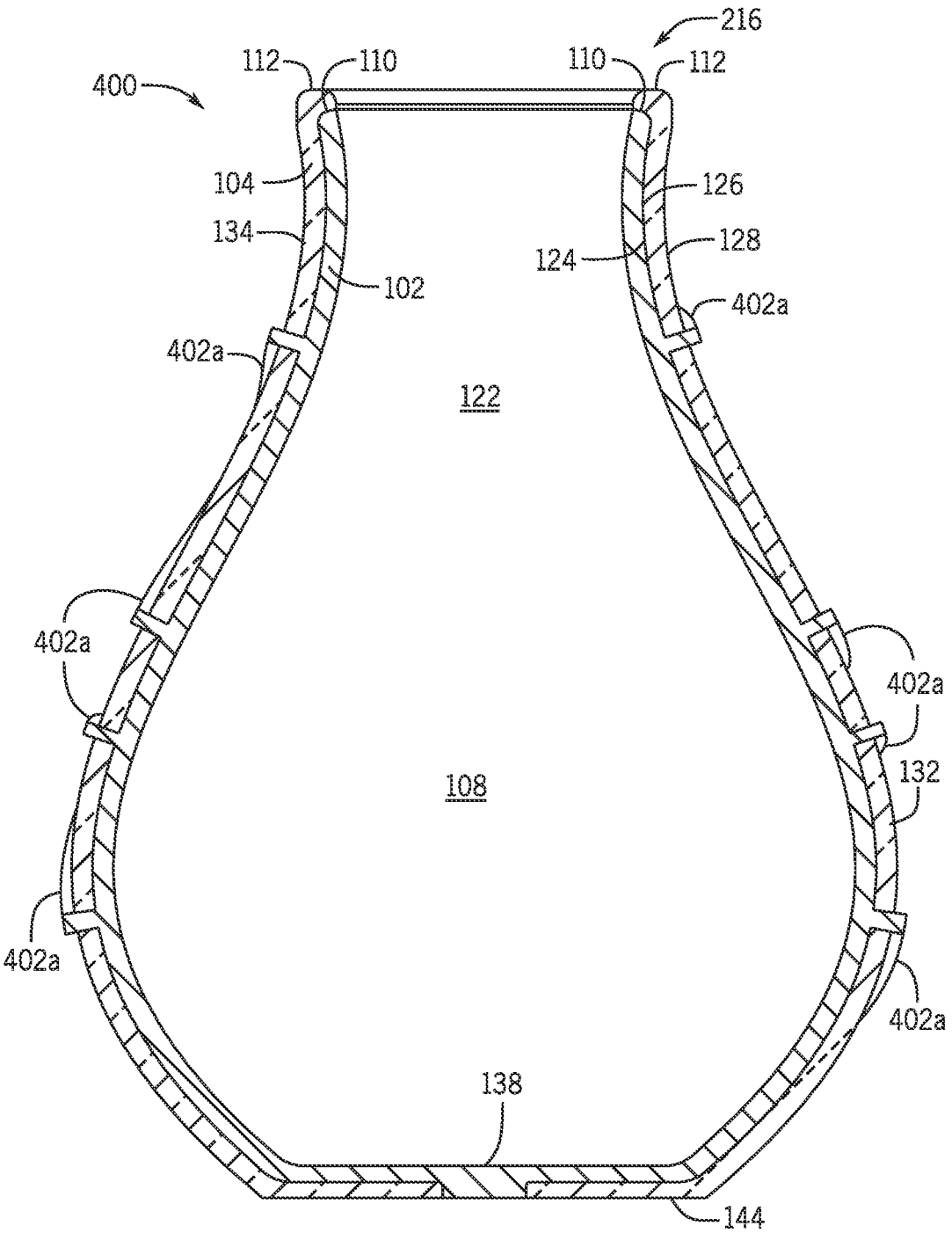
FIG. 4B is a section view of the three dimensional article of FIG. 4A taken along section line 4B-4B of FIG. 4A.

FIGS. 4A-4B shows an example of a three dimensional article 400 similar in many aspects to the other three dimensional articles disclosed herein, such as the three dimensional article 100, the three dimensional article 200, and/or the three dimensional article 300. In the example shown, the three dimensional article 400 includes a rim 216 similar to that of the three dimensional article 200. However, in other embodiments, the three dimensional article 400 could include a rim 142 or a rim 302, or another rim disclosed herein.

The three dimensional article 400 includes at least one surface feature 402*a* that extends from outer surface of the inner body 124 through the outer body 104, penetrates the outer surface of the outer body 128, and may, in some instances extend above the outer surface of the outer body 128. The three dimensional article 400 also includes surface features 402*b* that extend from the outer surface of the inner body 124 partially through the thickness Tn of the outer body 104, but do not penetrate the outer surface of the outer body 128. As shown for example in FIG. 4B, the surface features 402*a* may gradually extend away from the outer surface of the inner body 124 such that portions of the surface feature 402*a* do not penetrate the outer surface of the outer body 128, while other portions of the surface feature 402*a* do penetrate and/or rise above the outer surface of the outer body 128. Such surface features 402*a* may provide functional and/or aesthetic properties to the three dimensional article 400. For example, the portion of the surface feature 402*a* that rises above the outer surface of the outer body 128 may provide a high-friction surface feature suitable to enable the three dimensional article 400 to be gripped by a user. In another example, the surface feature 402*a* may provide a novel aesthetic appearance of the three dimensional article 400 such as providing the appearance of the surface feature 402*a* rising out of the glass-like outer body 104, which effect is not easily achieved with actual glass.

Figure 5A:
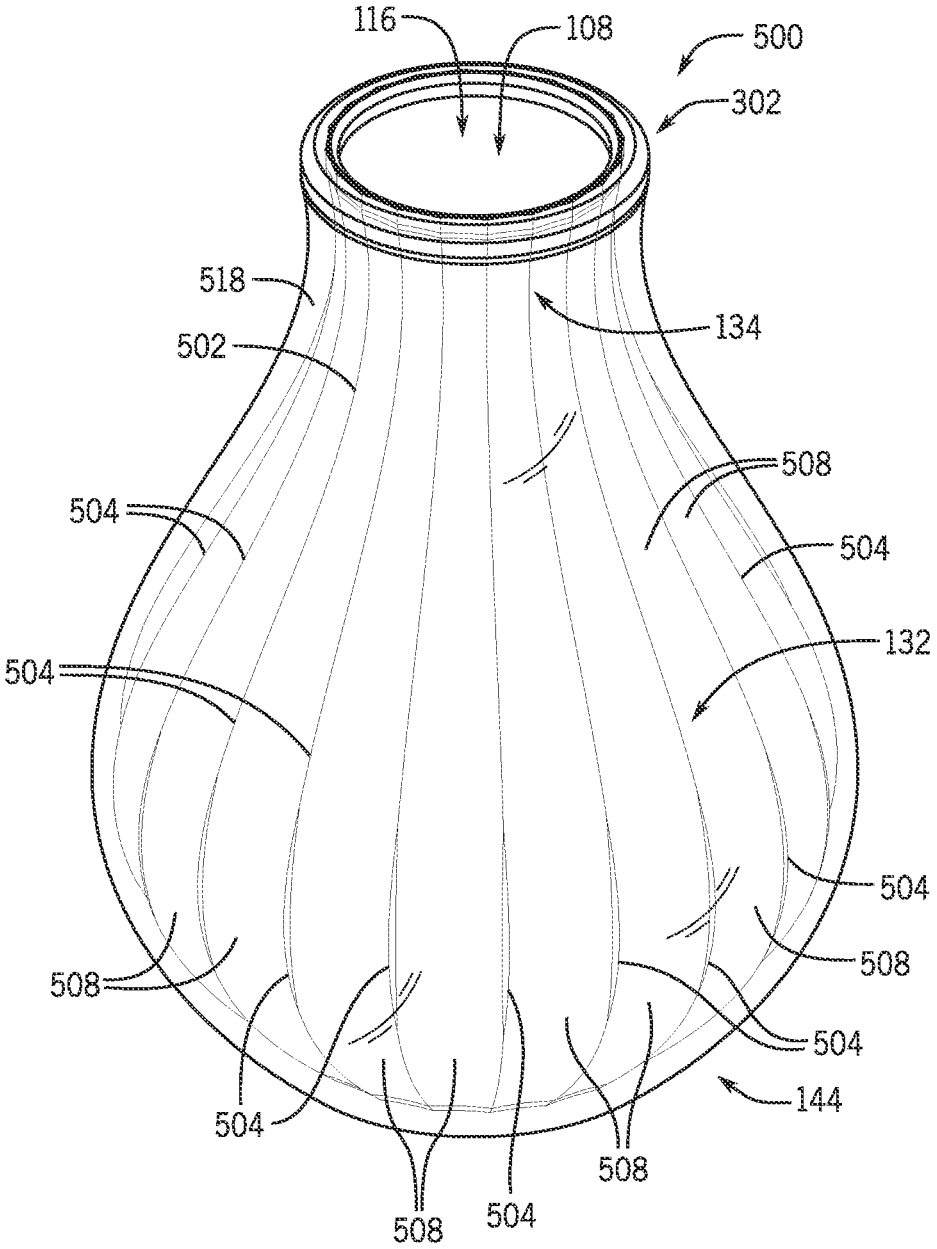
Figure 5B:
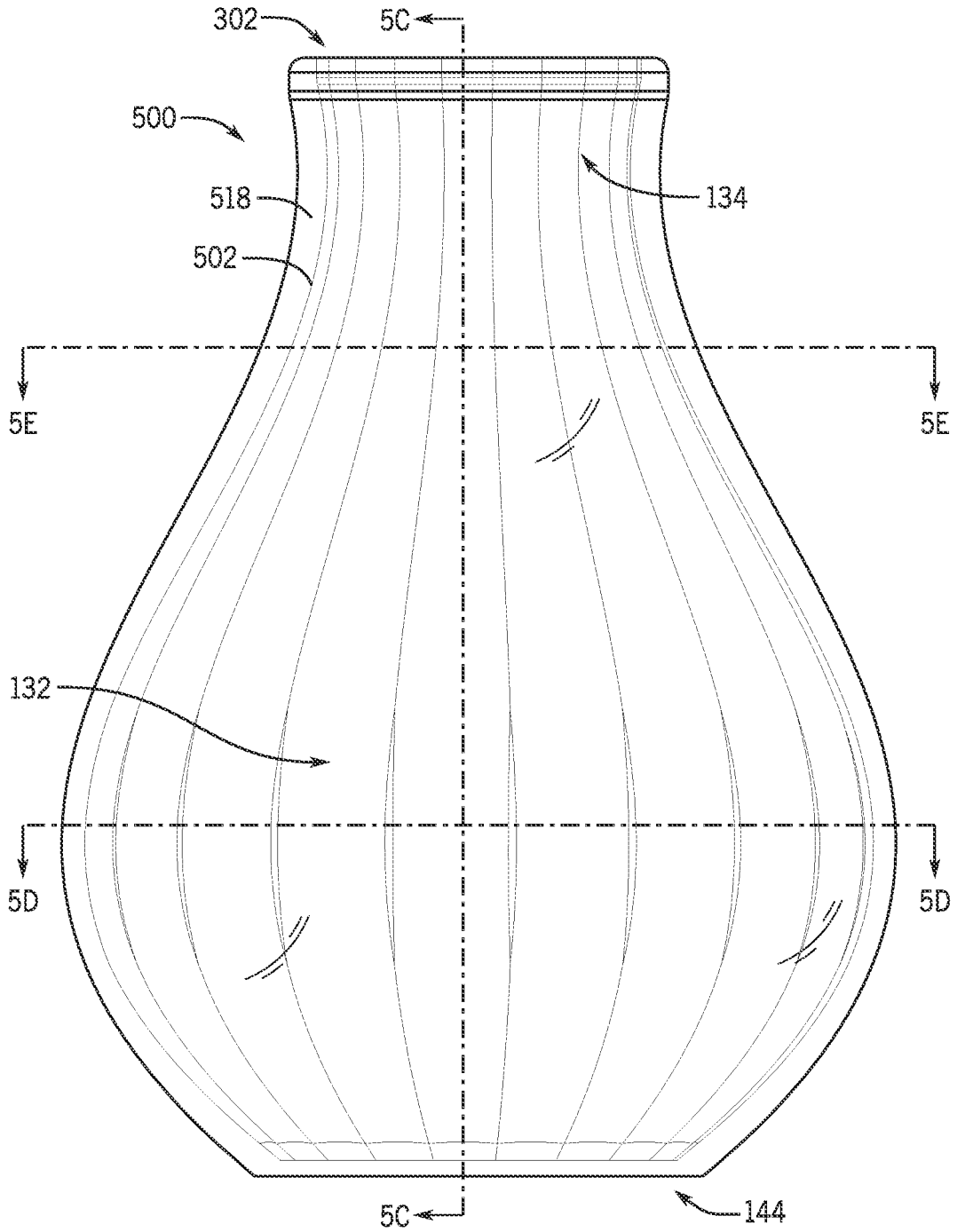
FIG. 5B is a side elevation view of the three dimensional article of FIG. 5A.
Figure 5C:
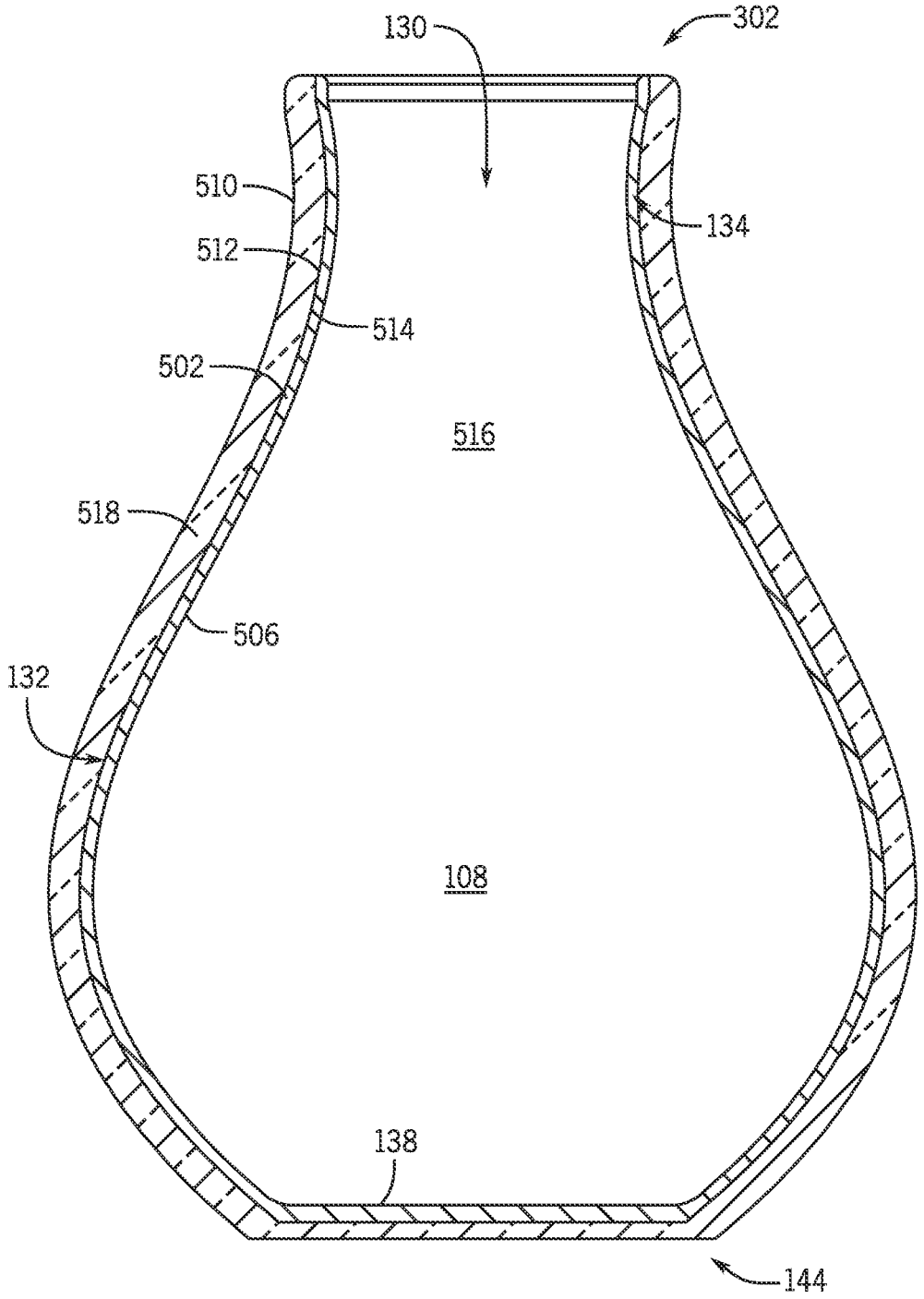
FIG. 5C is a section view of the three dimensional article of FIG. 5A taken along section line 5C-5C of FIG. 5B.
Figure 5D:
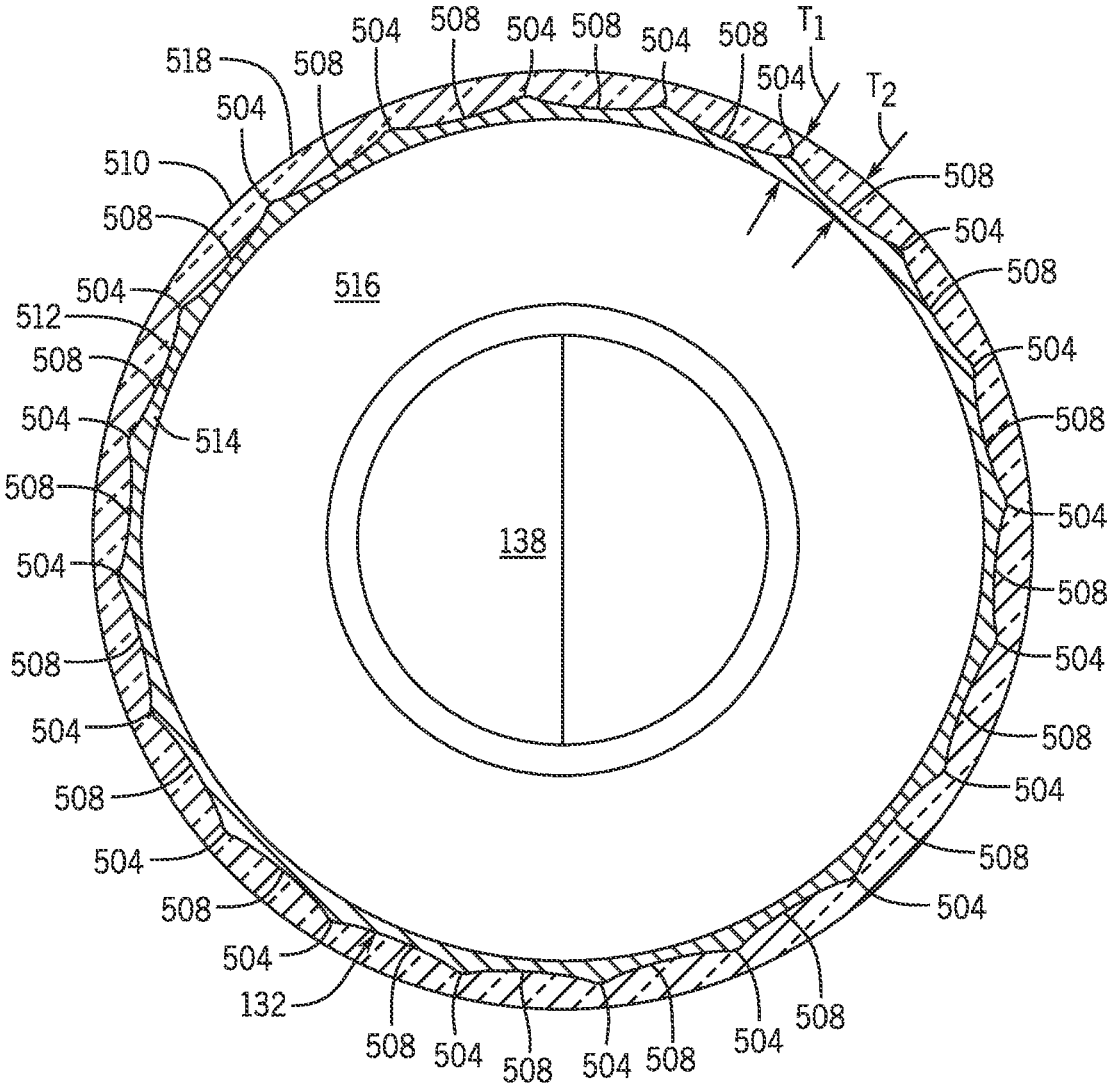
FIG. 5D is a section view of the three dimensional article of FIG. 5A taken along section line 5D-5D of FIG. 5B.
Figure 5E:
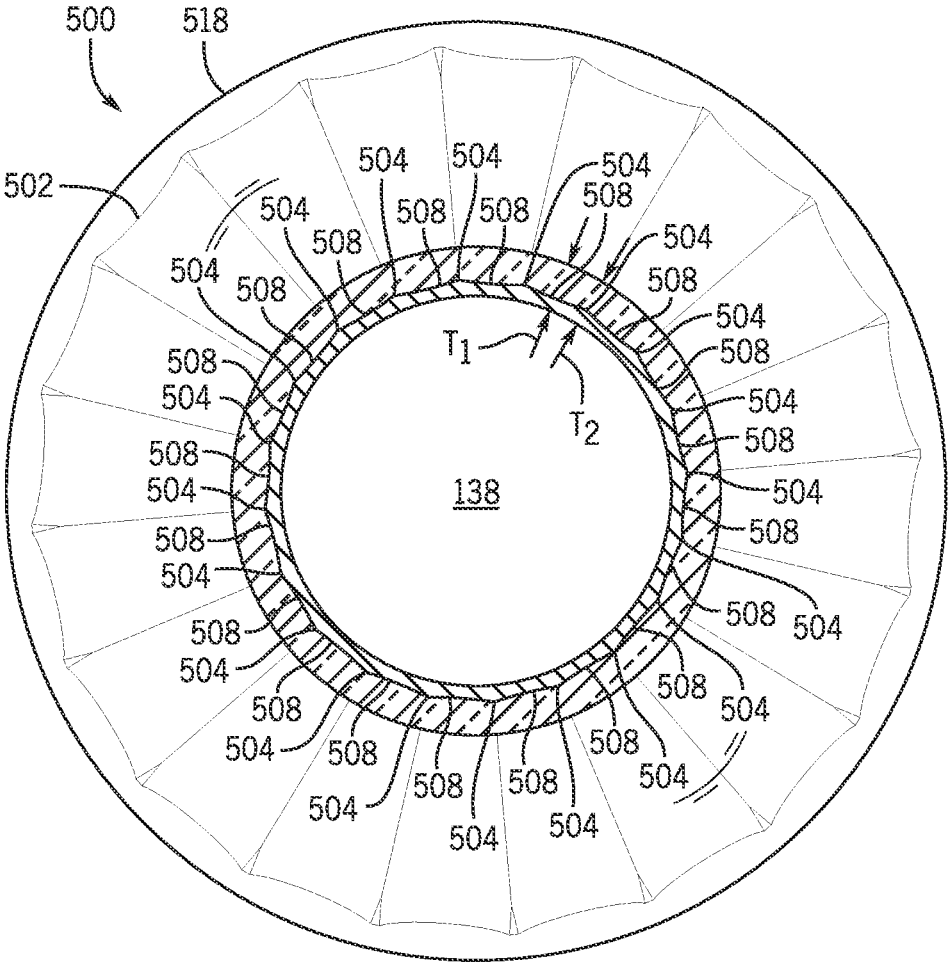
FIG. 5E is a section view of the three dimensional article of FIG. 5A taken along section line 5E-5E of FIG. 5B.
Figure 6A:
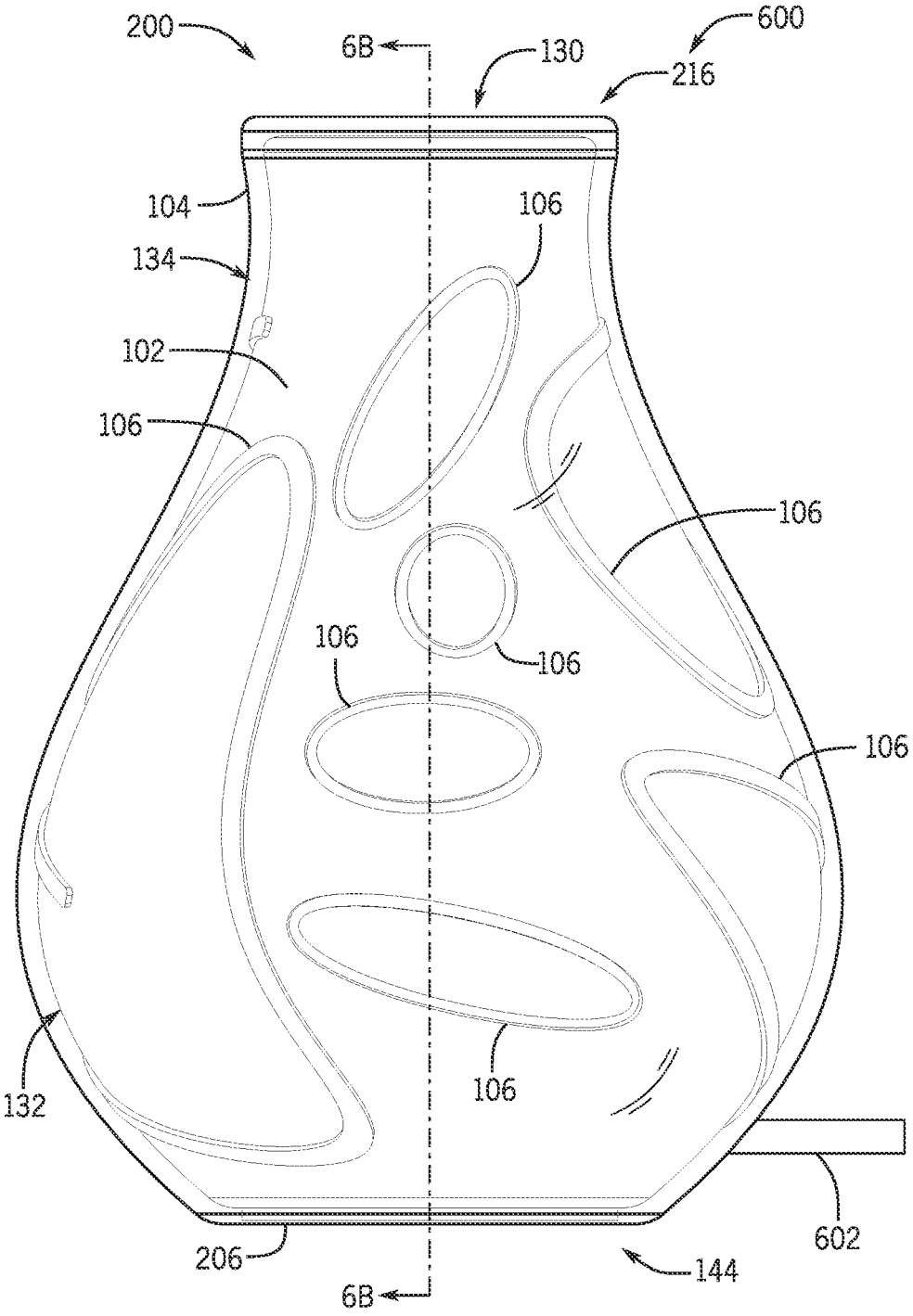
FIG. 6A is a side elevation view of a luminaire.
Figure 6B:
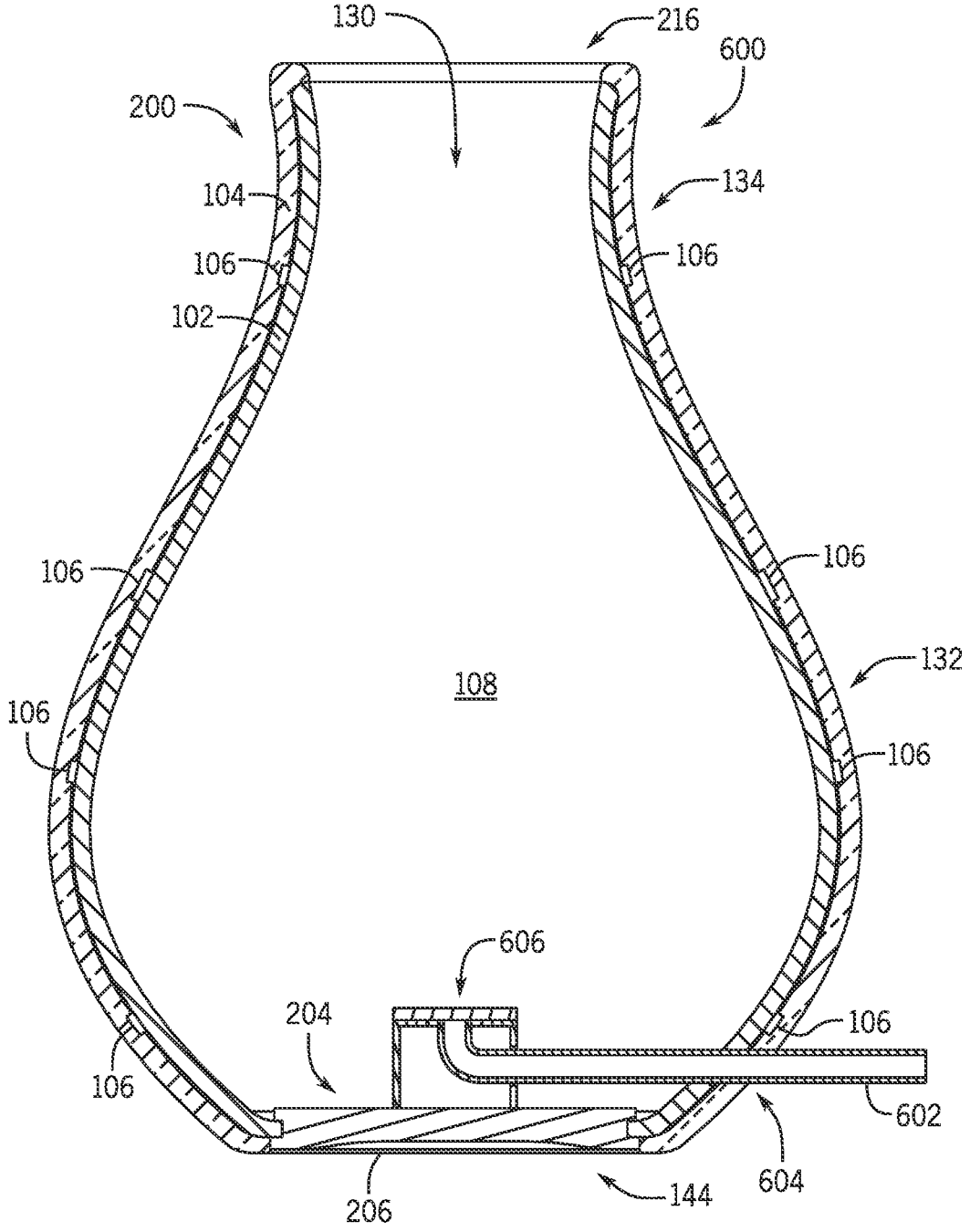
FIG. 6B is a section view of the luminaire of FIG. 6A taken along section line 6B-6B of FIG. 6A.
Figure 6C:
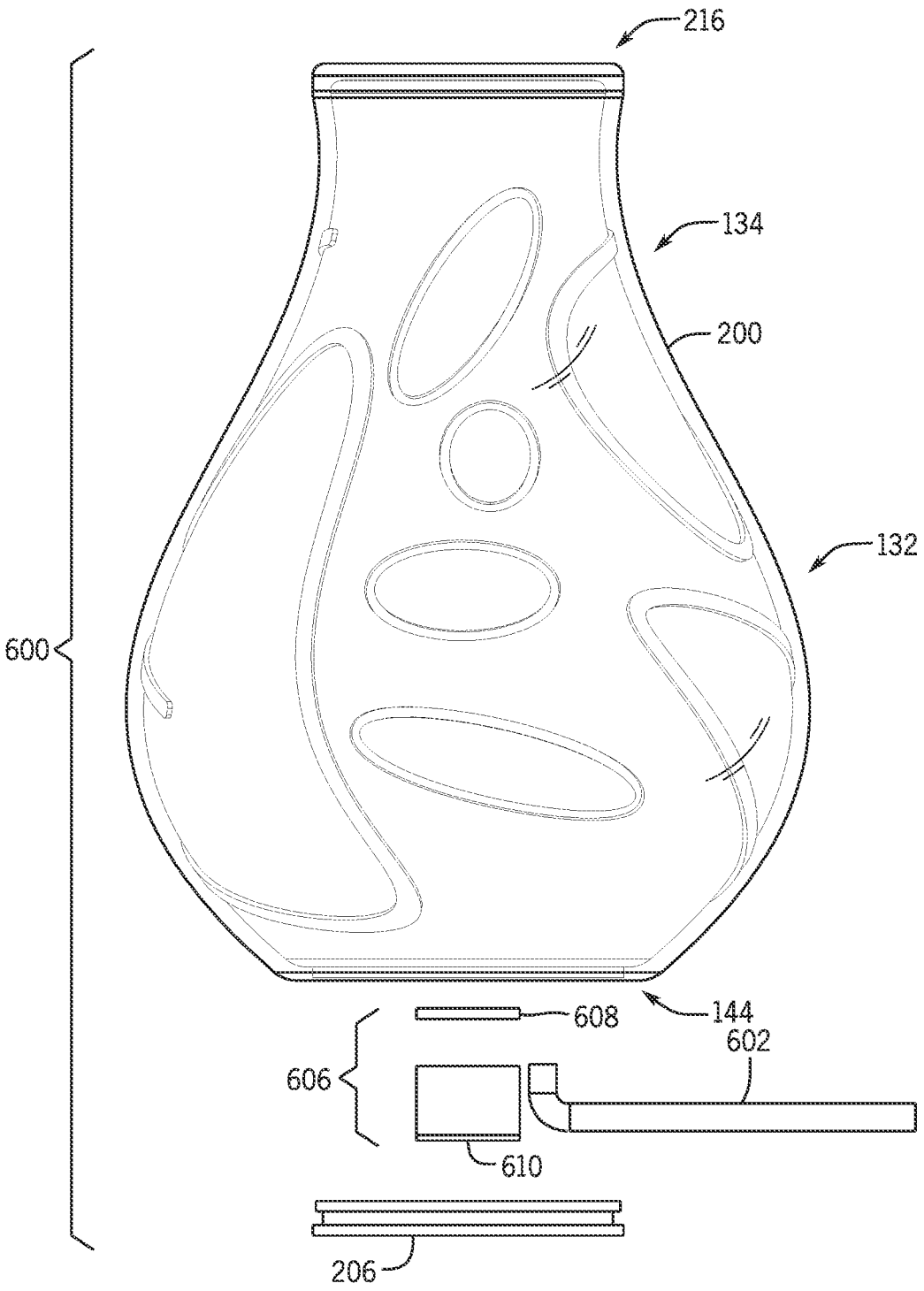
FIG. 6C is a partially exploded view of the luminaire of FIG. 6A.
Figure 6D:
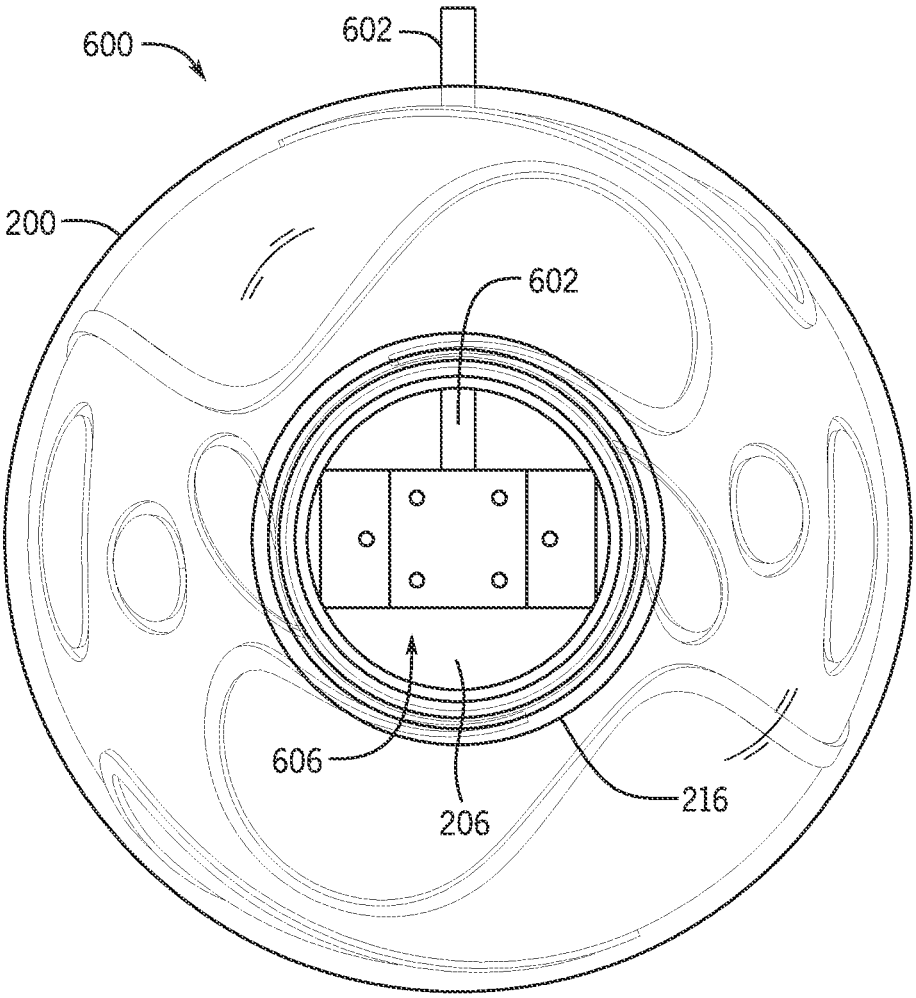
FIG. 6D is a plan view of the luminaire of FIG. 6A.

An example of a three dimensional article 500 is shown in FIGS. 5A-5E. The three dimensional article 500 may be similar to other three-dimensional articles disclosed herein in many aspects. However, the three dimensional article 500 may vary from other three-dimensional articles in that the outer body 518 partially conforms to the shape of the inner body 502. In the three dimensional article 500, the inner body 502 may have a patterned outer surface of the inner body 514. The inner surface of the outer body 512 conforms to the pattern of the outer surface of the inner body 514. However, the outer surface of the outer body 510 is smooth such that the pattern of the inner surface of the inner body 516 does not result in a corresponding pattern of the outer surface of the outer body 510. For example, the inner body 502 may include a plurality of ribs 504 with scallops 508 disposed therebetween. For example, the relative thicknesses of the inner body 502 and outer body 518 may vary about the three dimensional article 500 while the total thickness of the inner body 502 and outer body 518 together remains substantially the same at certain points of the three dimensional article 500. See, for example FIGS. 5D and 5E showing a combined thickness T1 of the inner body 502 and outer body 518 in a scallop 508 region and a combined thickness T2 of the inner body 502 and the outer body 518 in a rib 504 region. While the inner body 502 may be relatively thinner than the outer body 518 in the scallop 508 region and the inner body 502 may be relatively thicker than the outer body 104 in the rib 504 region, the combined thicknesses T1 and T2 of the inner body 502 and the outer body 518 may be substantially the same. Thus, the inner body 502 may have a thickness that varies according to the scallop 508/rib 504 pattern, and the outer body 104 may have a thickness that varies to fill in the scallops 508 to result in a smooth outer surface of the three dimensional article 500. See, for example, FIG. 5C showing a section view of the three dimensional article 500 taken along line 5C-5C of FIG. 5B in the center of a scallop 508. The inner body 502 is thinner in the scallop 508 regions than in the rib regions. The outer body 518 is correspondingly thicker in the scallop 508 regions such that the inner surface of the outer body 512 substantially conforms to the outer surface of the inner body 514. Meanwhile, the outer surface of the outer body 512 is smooth. In other examples, the inner body 502 may have other geometrically-shaped cross sections. For example, the outer surface of the inner body 514 may be triangular, square, rectangular, pentagonal, hexagonal, shaped like other polygons, or may be irregularly shaped, while the inner surface of the outer body 512 conforms to the outer surface of the inner body 514, the thickness of the outer body 518 varies such that the outer surface of the outer body 510 is smooth.

With reference to FIG. 6A-FIG. 6D, an example of a luminaire 600 is shown. The luminaire 600 includes a three dimensional article 200 as previously described. Other three-dimensional articles disclosed herein may be used to form a portion of a luminaire 600. In the luminaire 600, the plug 206 may have a light source 606 coupled thereto or formed therewith. As shown for example in FIG. 6C, the light source 606 may include an emitter 610 and a lens 608. The emitter 610 may be a light emitting diode ("LED"), incandescent, candle, or other device that emits light when supplied with an electrical current. The lens 608 is optional and may direct, focus or refract light emitted by the emitter 610.

In some examples, the light source 606 may be molded into the plug 206. In another example, the light source 606 may be adhered to the plug 206 with an adhesive or mechanically affixed to the plug 206 by a fastener such as a screw, bolt, rivet, clamp, or the like. The light source 606 may be in electrical communication with a power source via a conductor 602. The power source may be any suitable power source that can cause the light source 606 to illuminate. For example, the power source may be mains power, a direct current power source, battery, or the like. The conductor 602 may pass through an aperture 604 formed in the three dimensional article 200. The aperture 604 may pass through the inner body 102 and the outer body 104.

The light source 606 may emit light that is transmitted through at least a portion of the inner body 102 and the outer body 104. Either or both of the inner body 102 and/or the outer body may alter the light emitted by the light source 606. For example, the inner body 102 and/or 104 may attenuate the intensity of the light, change the hue, reflect, refract, or change the direction of the light emitted by the light source 606. For example, the surface features 106 of the inner body 102 may cause one or more patterns and/or colors to be imbued to the light emitted by the 606. A portion of the light emitted by the light source 606 may pass through the aperture 130 forming a spot light effect. The luminaire 600 may thus provide an aesthetically pleasing and functional source of illumination. The luminaire 600 may be configured to be used as a desk lamp.

Figure 7A:
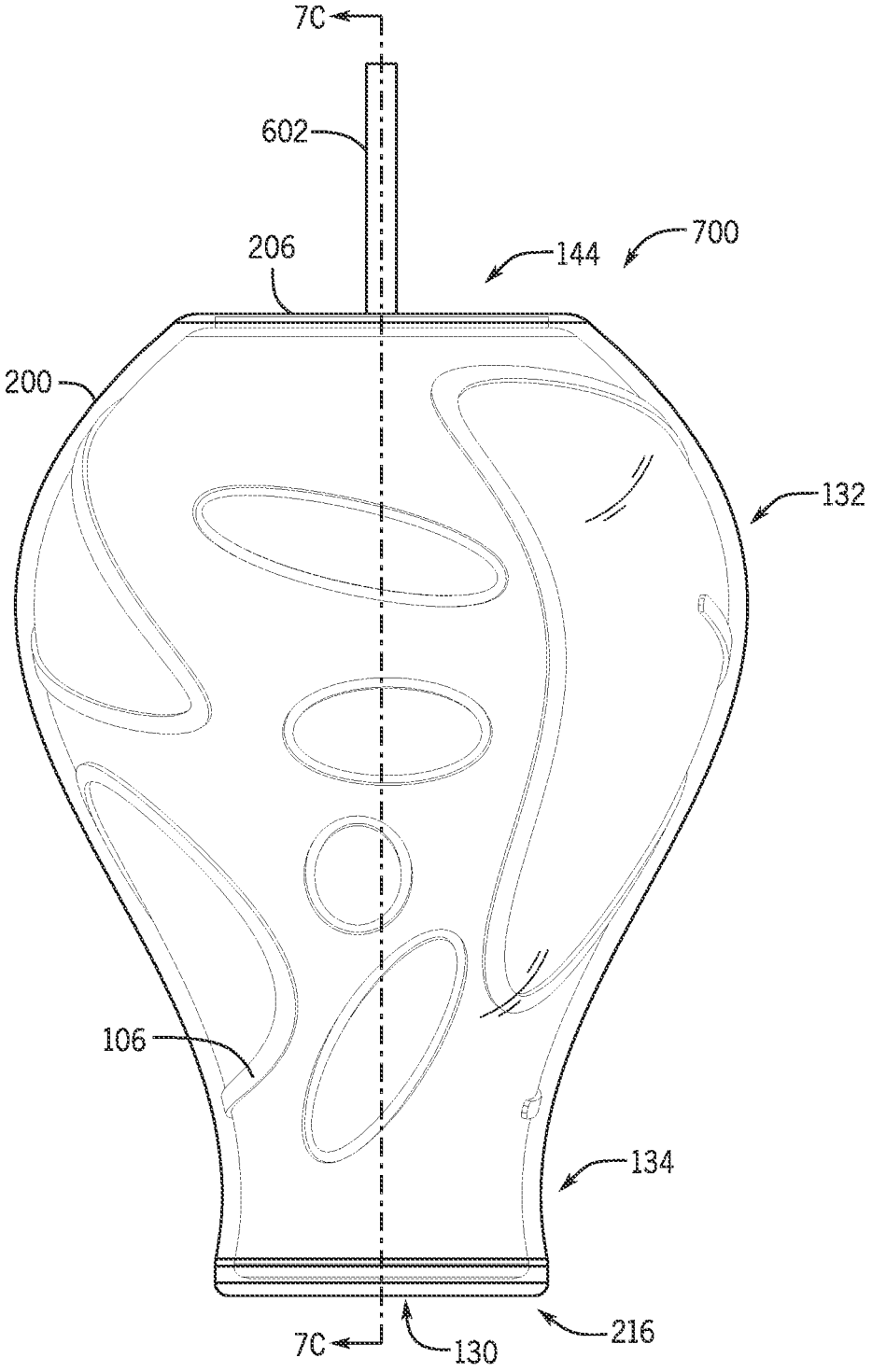
FIG. 7A is a side elevation view of a luminaire.
Figure 7B:
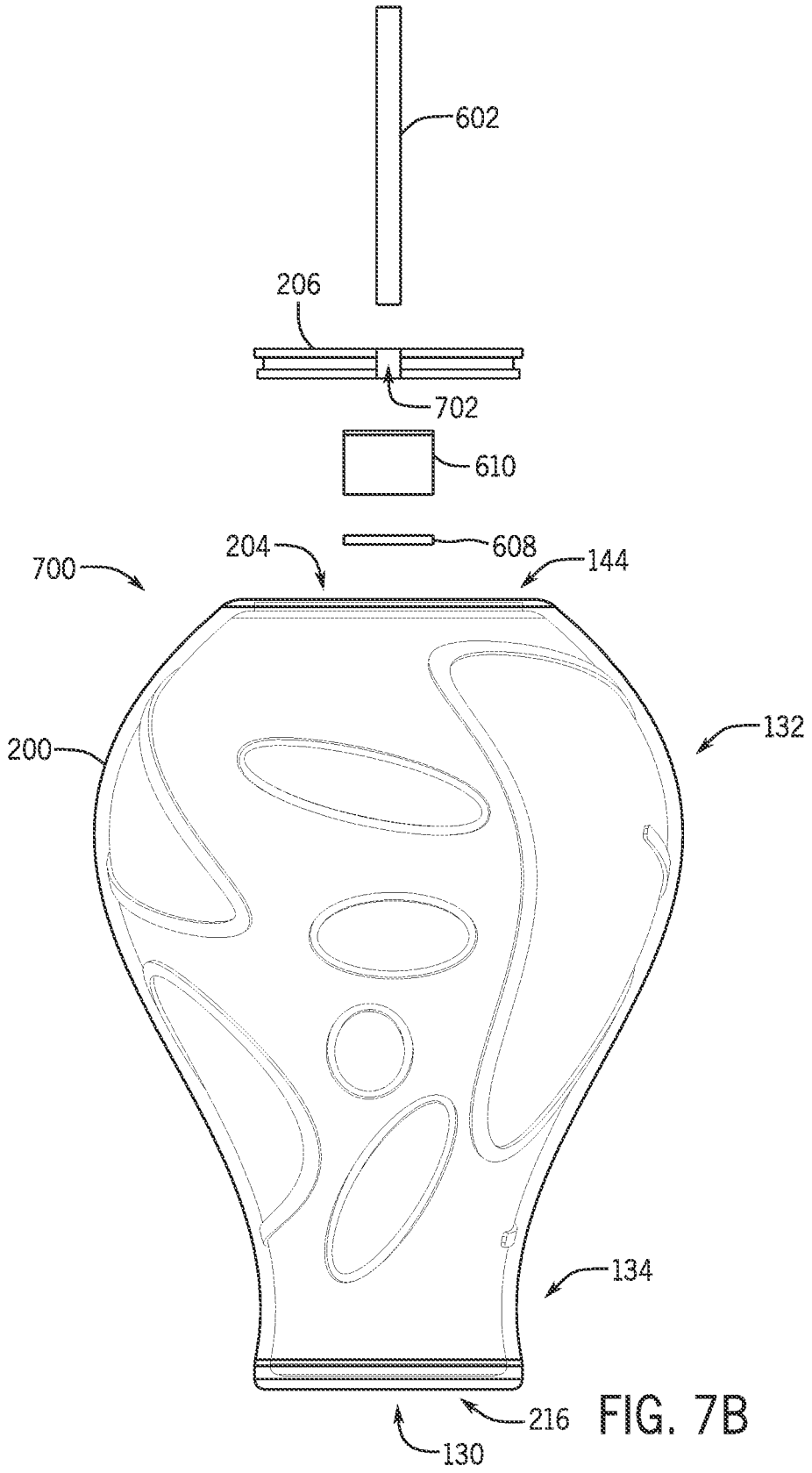
FIG. 7B is a partially exploded view of the luminaire of FIG. 7A.
Figure 7C:
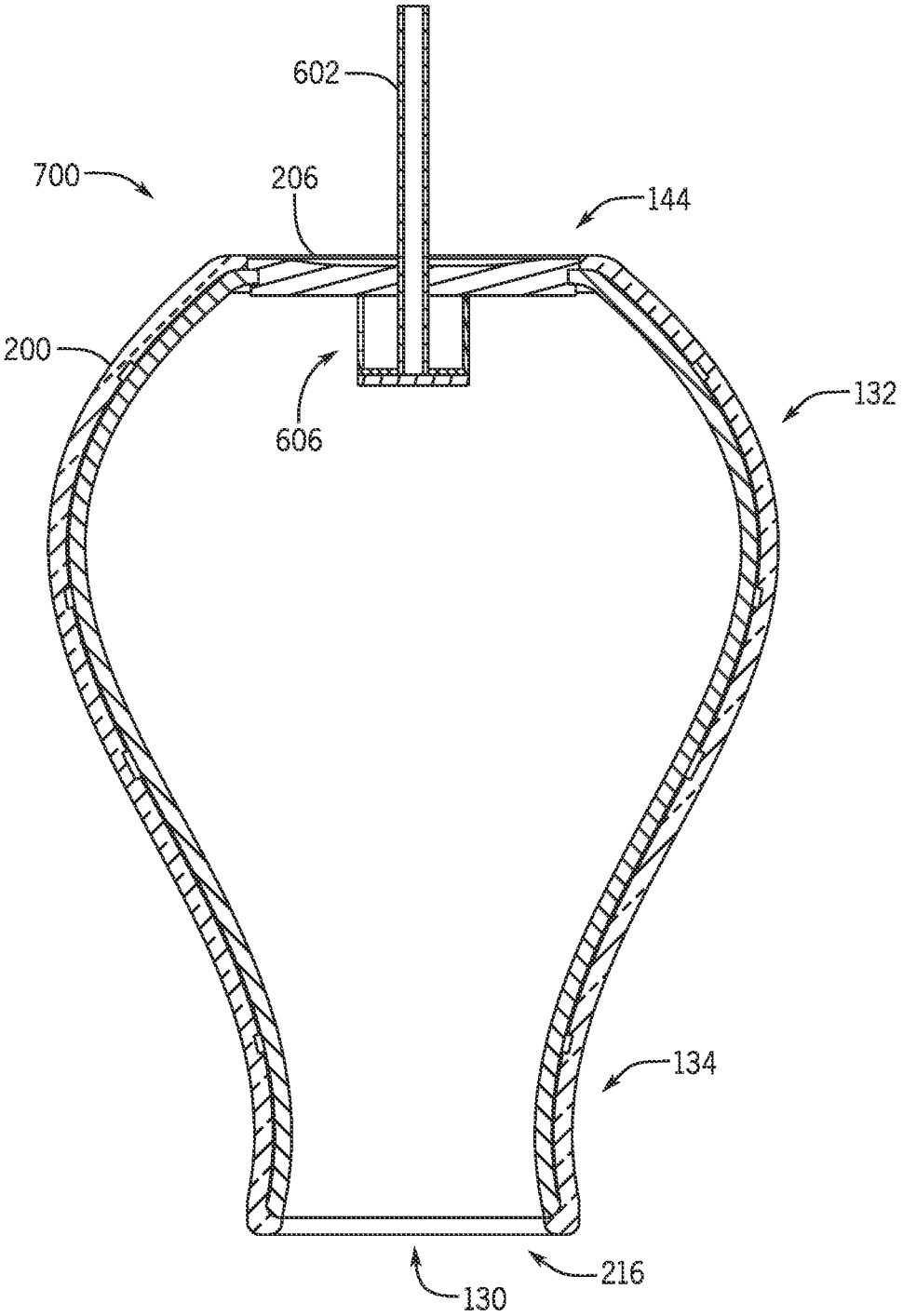
FIG. 7C is a section view of the luminaire of FIG. 7A taken along section line 7C-7C of FIG. 7A.
Figure 8B:
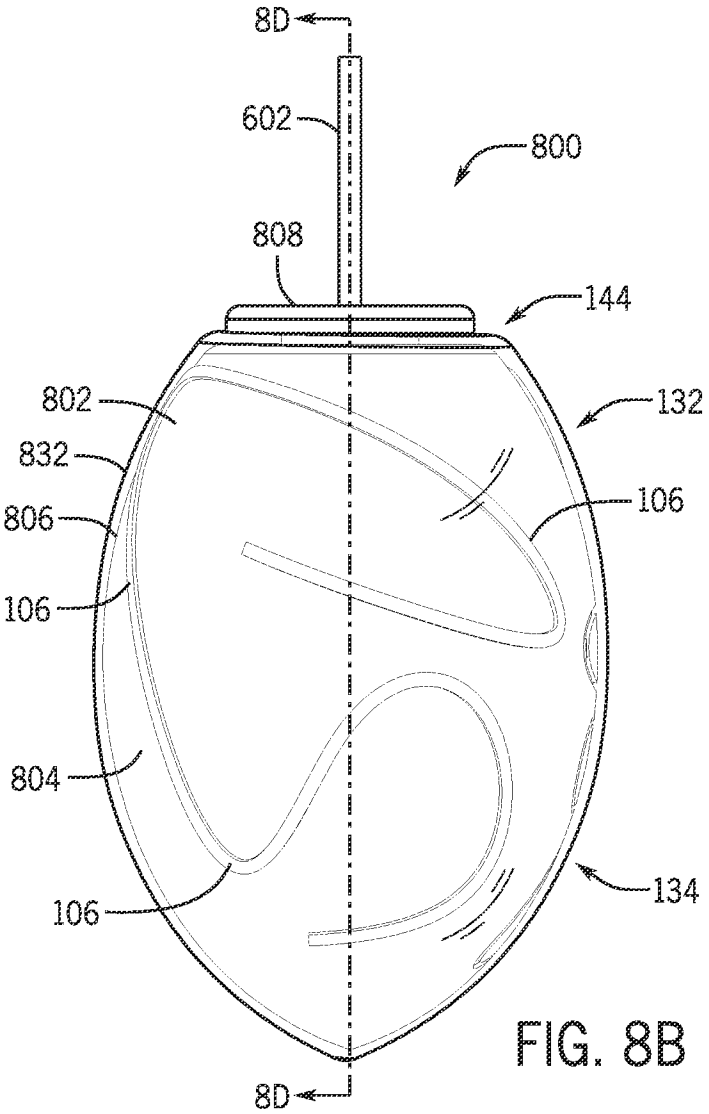
FIG. 8B is a side elevation view of the luminaire of FIG. 8A.
Figure 8A:
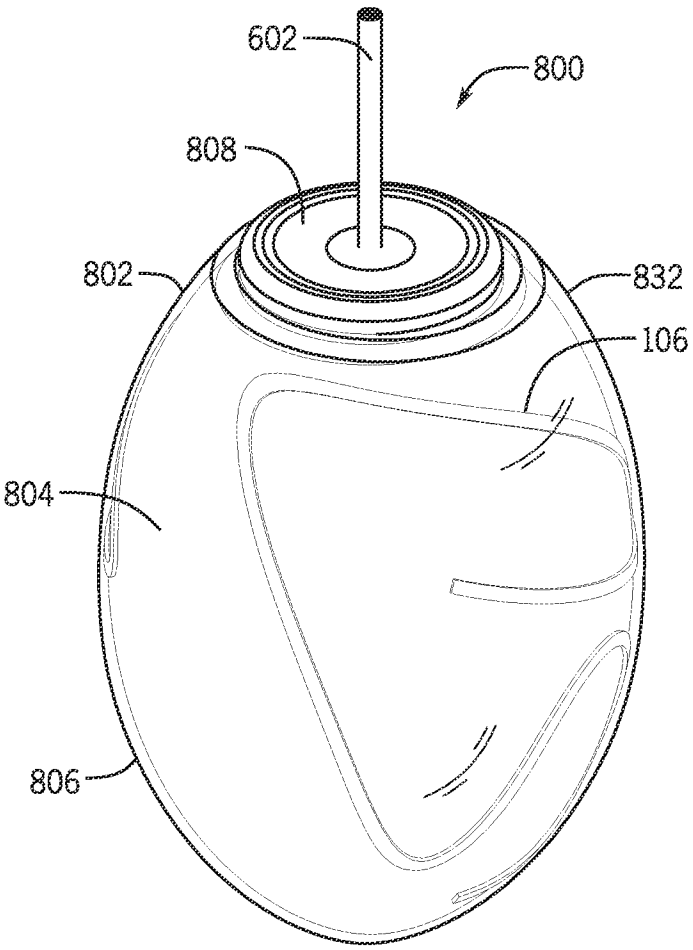
FIG. 8A is a perspective view of a luminaire.
Figure 8D:
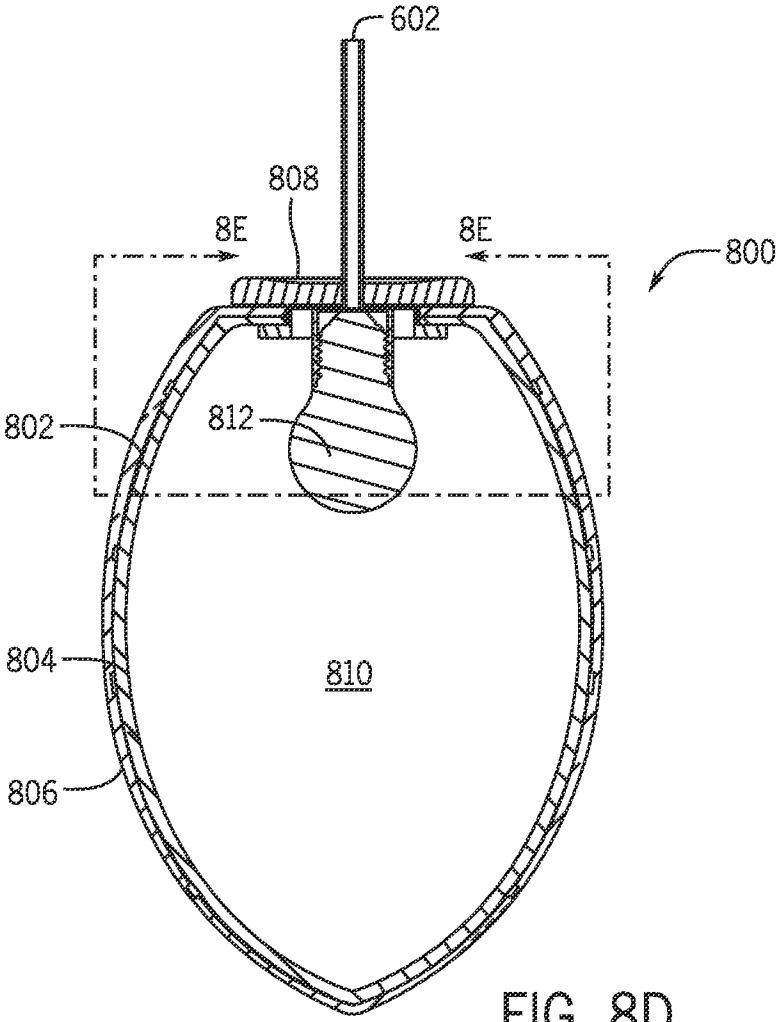
FIG. 8D is a section view of the luminaire of FIG. 8A taken along line 8D-8D of FIG. 8B.
Figure 8C:
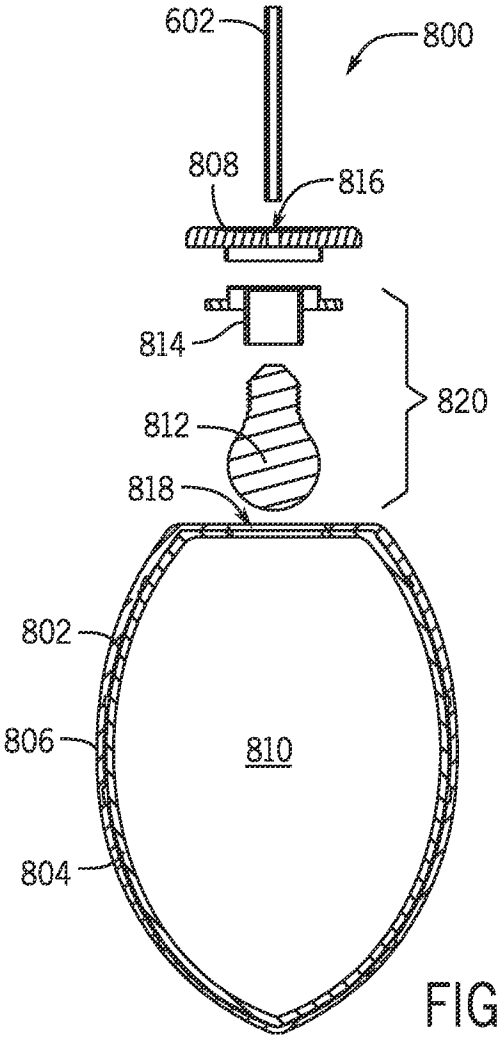
FIG. 8C is a partially exploded section view of the luminaire of FIG. 8A taken along line 8D-8D of FIG. 8B.
Figure 8E:
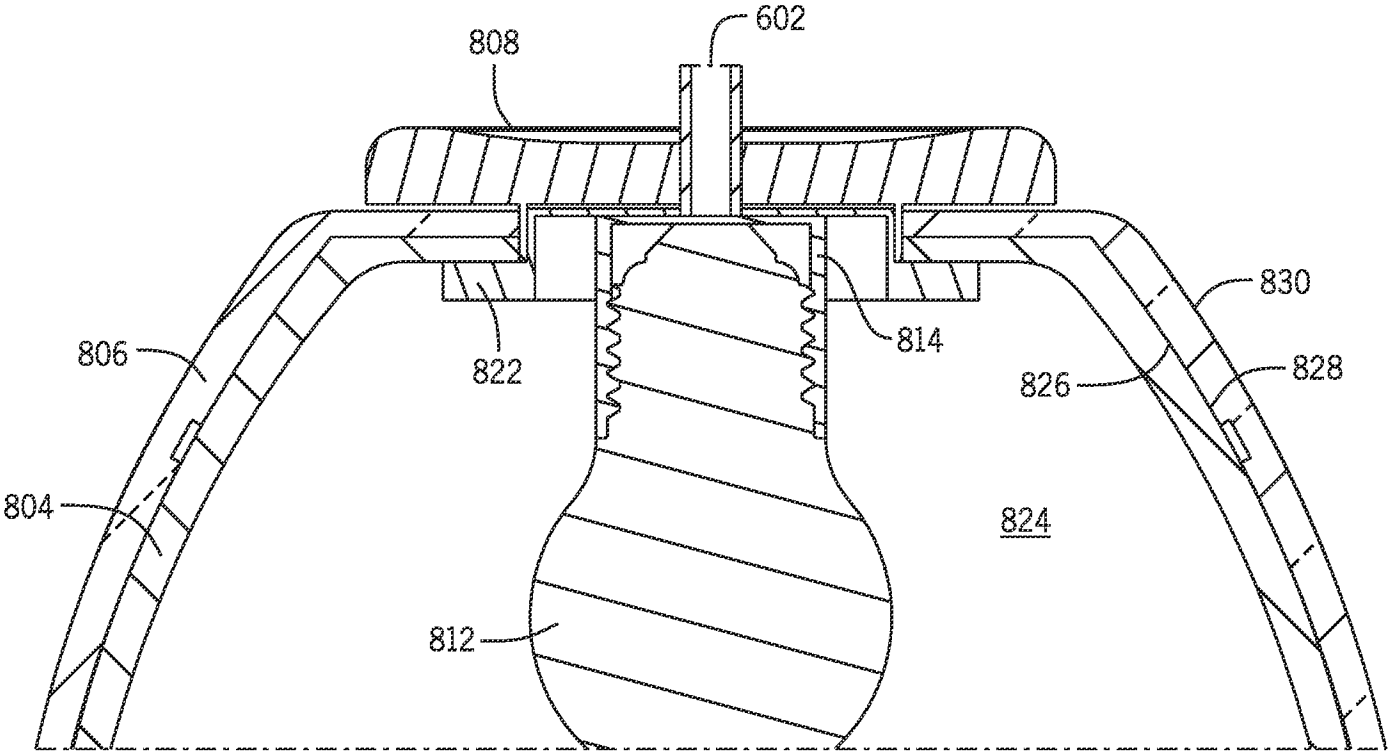
FIG. 8E is a partial detail view of the luminaire of FIG. 8A taken at line 8E-8E of FIG. 8D.
Figure 9A:
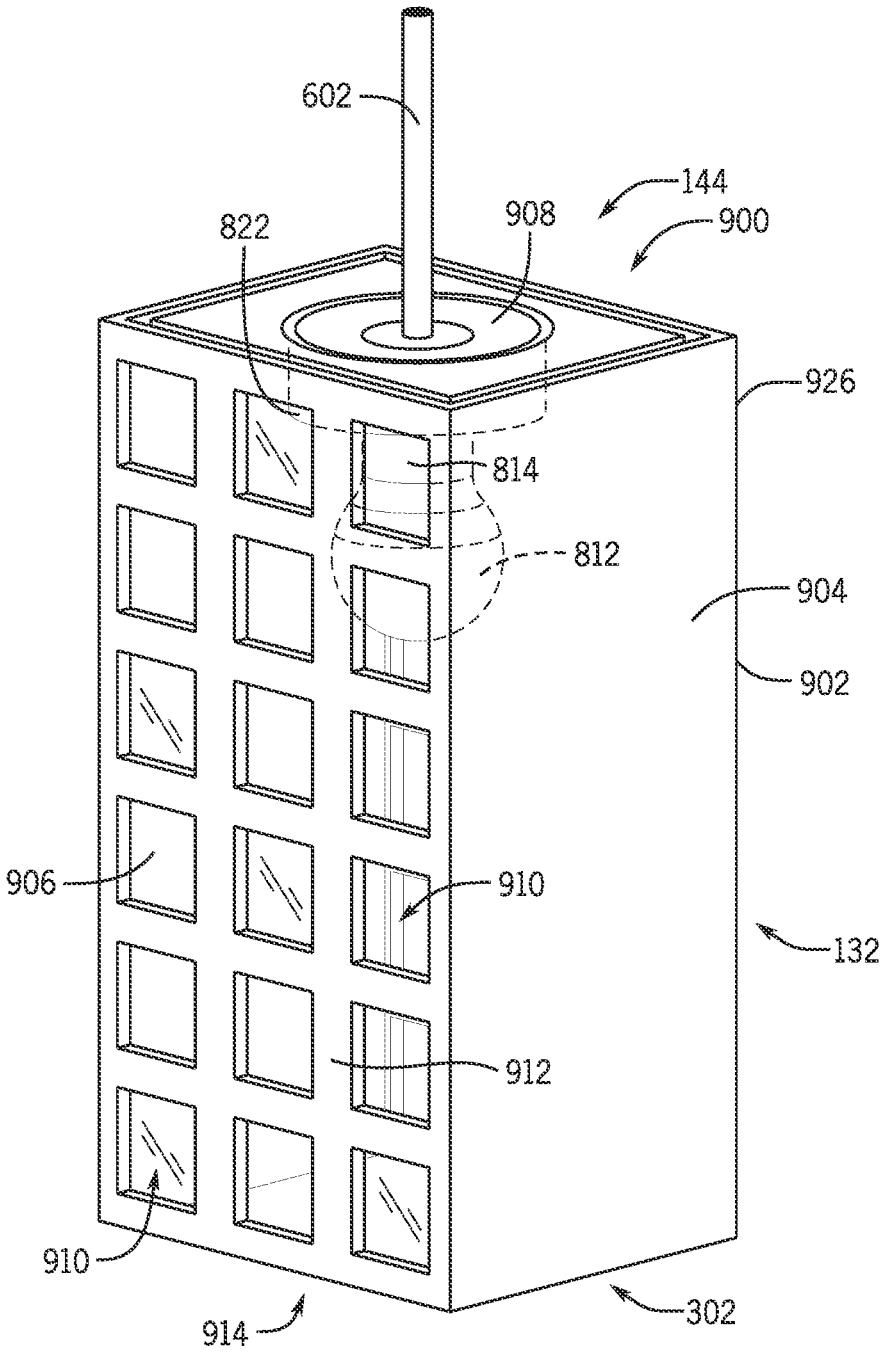
FIG. 9A is a perspective view of a luminaire.
Figure 9B:
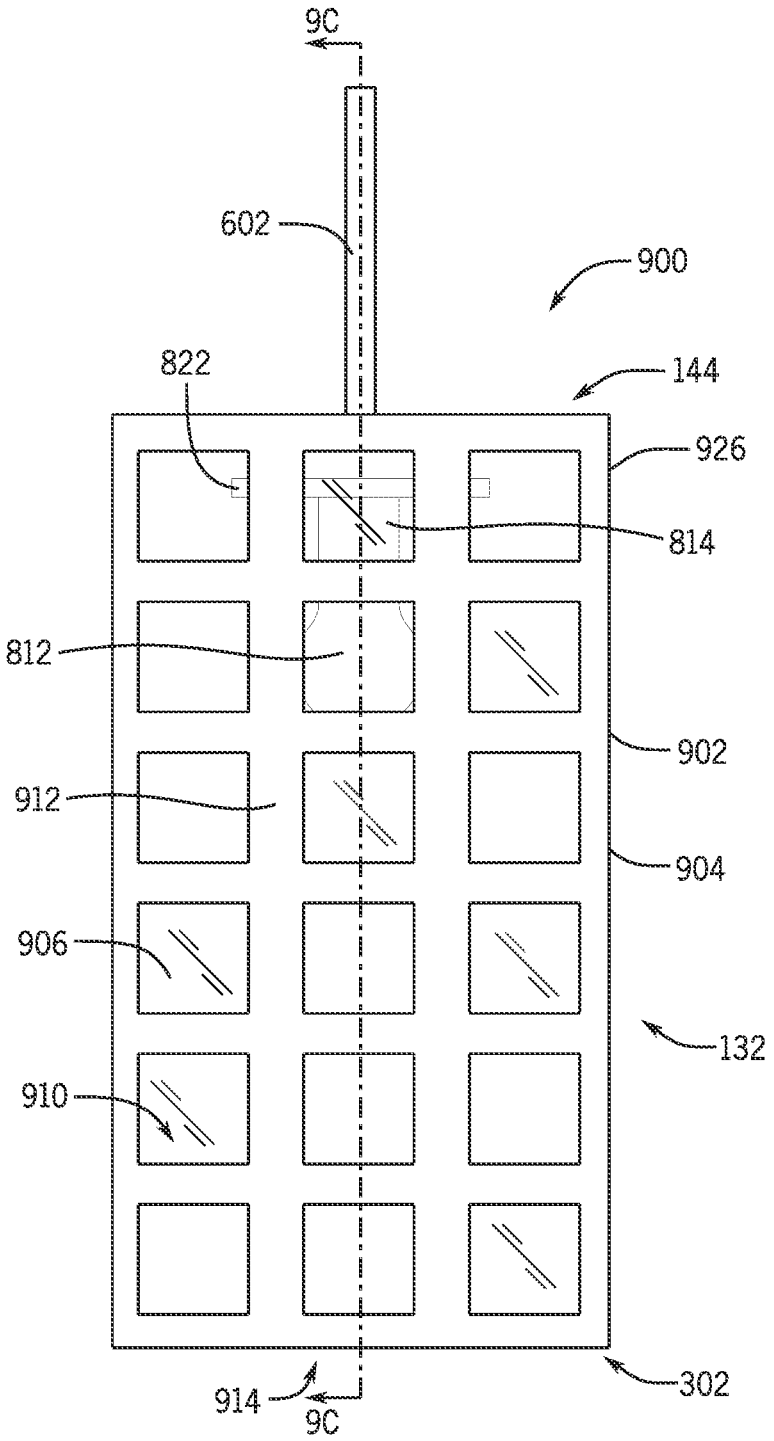
FIG. 9B is a side elevation view of the luminaire of FIG. 9A.
Figure 9C:
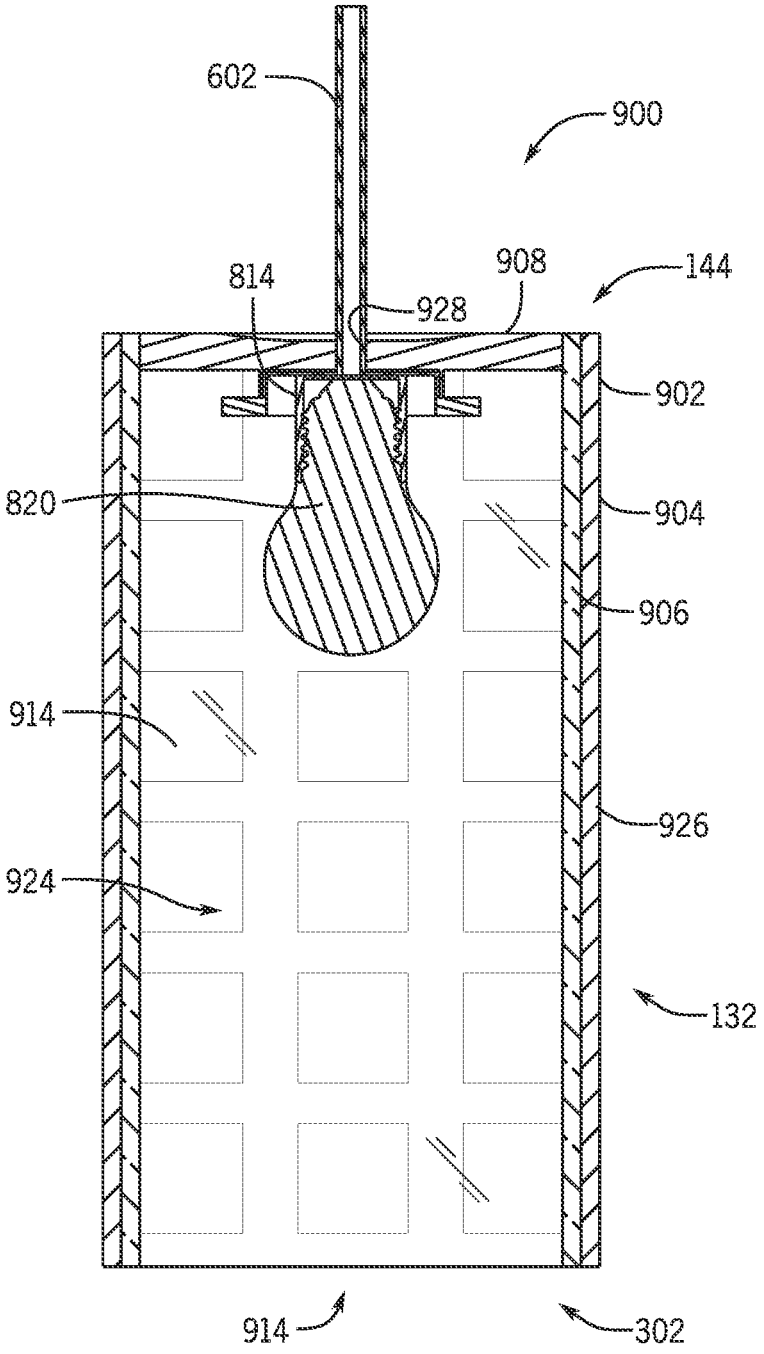
FIG. 9C is a section view of the luminaire of FIG. 9A taken along line 9C-9C of FIG. 9B.
Figure 9D:
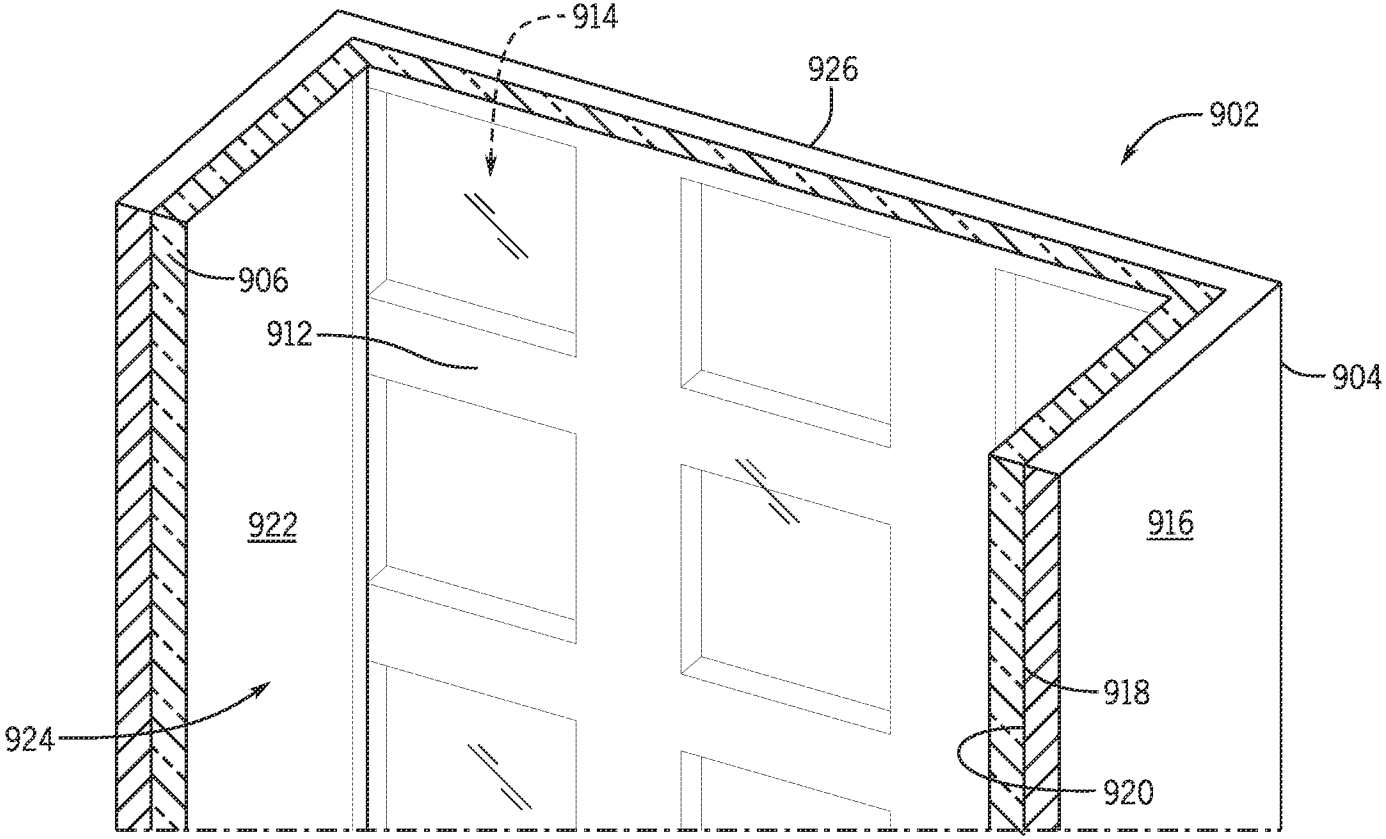
FIG. 9D is a partial detail view of the luminaire of FIG. 9A.

With reference to FIGS. 7A-7C, an example of a luminaire 700 is shown similarly formed with a three dimensional article 200. The luminaire 700 may be similar to the luminaire 600 in many aspects. For example, the luminaire 700 may have similar effects on the light emitted by the light source 606 as the luminaire 600. Other three-dimensional articles disclosed herein may be used to form a portion of a luminaire 700. The luminaire 700 may be configured to be used as a pendant light. The luminaire 700 includes a light source 606 similar to the light source 606 used in the luminaire 600. In the luminaire 700, the conductor 602 may pass through a conductor aperture 702 formed in the plug 206 rather than through an aperture 604 formed in the inner body 102 and the outer body 104. The luminaire 700 may be configured to be suspended by the conductor 602. For example, the conductor 602 may include electrical wires that provide power to the light source 606 as well as structural elements that can support the weight of the luminaire 700 from a ceiling, wall or similar structure. The luminaire may have similar effects on light emitted by the light source as with the luminaire 600.

With reference to FIGS. 8A-8E, an example of a luminaire 800 is disclosed. The luminaire 800 may be similar to the luminaire 600 and the luminaire 700 in many aspects. The luminaire 800 may be suitable to be used as a pendant light. For example, the luminaire 800 may have similar effects on the light emitted by a light source 820 as the luminaire 600 and/or the luminaire 700. The luminaire 800 includes a three dimensional article 802 similar in many aspects to other three-dimensional articles disclosed herein. For example, the three dimensional article 802 has an inner body 804 and an outer body 806 that form a main body 832 as described previously with other three-dimensional articles disclosed herein. The three dimensional article 802 may differ from other three dimensional articles in that it does not include a rim portion, but rather has a closed end of the main body opposite the base. The inner body 804 and/or outer body 806 may include surface features 106 as previously described. For example, one or more surface features 106 may be formed on the outer surface of inner body 826 and protrude into the inner surface of the outer body 828. In some examples, the one or more surface features 106 may protrude through the outer body 806 to or beyond the outer surface of the outer body 830. The inner surface of the inner body 824 forms a wall of an internal compartments 810 of the three dimensional article 802. The internal compartment 810 may house or receive a light source 606 or light source 820. The main body 832 of the three dimensional article 802 has an aperture 818 formed in one end. The end opposite the aperture 818 is closed. In the example shown, the main body 832 forms an ovoid or teardrop shape. In other examples, the main body 832 may form other shapes such as spheres, cubes, prisms, other polygonal shapes, or irregular shapes. The internal compartment 810 may be selectively closable by a plug 808 selectively receivable in the aperture 818. Similar to the luminaire 600 and the luminaire 700, the luminaire 800 includes a light source 820. The light source 820 may include a receptacle 814 that selectively receives an emitter 812. The emitter 812 shown for example may be an Edison bulb (either LED or incandescent). The emitter 812 may be replaceable, such as when it burns out or reaches its end of life. In other examples, a light source 606 previously described may be used. The receptacle 814 may be coupled or couplable to the plug 808 and operative to receive the emitter 812. The receptacle 814 may include a flange 822 that, when assembled with the main body 832, captures a portion of the main body 832 between the flange 822 and the plug 808. Such a structure may serve to secure the light source 820 to the three dimensional article 802. The receptacle 814 may include female threads that engage with male threads of the emitter 812 to secure the emitter 812 within the luminaire 800 and/or provide an electrical connection to the emitter 812. The plug 808 may have an aperture 816 formed therein. The aperture 816 may be suitable to receive a conductor 602. As previously described, the conductor 602 may include electrically conductive wires, insulation, and/or structural support elements suitable to support and/or provide electrical power to the light source 820.

With reference to FIG. 9A-FIG. 9D, an example of a luminaire 900 is disclosed. The luminaire 900 may be similar to the luminaire 600, luminaire 700, and the luminaire 800 in many aspects. The luminaire 900 may be suitable to be used as a pendant light. For example, the luminaire 900 may have similar effects on the light emitted by a light source 820 as the luminaire 600, the luminaire 700, and/or the luminaire 800. The luminaire 900 includes a three dimensional article 902 similar in many aspects to other three-dimensional articles disclosed herein. For example, the three dimensional article 902 has an inner body 906 and an outer body 904 that form a main body 926 as described previously with other three-dimensional articles disclosed herein. The luminaire 900 may include a base, a rim and a medial portion but may omit the neck portion. The inner body 906 and/or outer body 904 may include surface features 106 as previously described. For example, the one or more surface features 106 may be formed on the outer surface of inner body 918 and protrude into the inner surface of outer body 920. In some examples, the one or more surface features 106 may protrude through the outer body 904 to or beyond the outer surface of outer body 916. The inner surface of inner body 922 forms a wall of an internal compartment 924 of the three dimensional article 902. The internal compartment 924 may house or receive a light source 606 or light source 820. The main body 926 of the three dimensional article 902 has an aperture 914 formed in one end. The end opposite the aperture 914 is closed. For example, an end wall 908 may be coupled to or formed with the inner body 906 to close the end of the main body 926 opposite the aperture 914.

In the example shown, the main body 926 forms a rectangular prismatic shape. In other examples, the main body 926 may form other shapes such as teardrop, ovoid, spheres, cubes, prisms, other polygonal shapes, or irregular shapes. Similar to the luminaire 600, the luminaire 700, and the luminaire 800, the luminaire 900 includes a light source 820. The light source 820 may include a receptacle 814 that selectively receives an emitter 812 as previously described. In other examples, a light source 606 previously described may be used. The end wall 908 may have an aperture 928 formed therein. The aperture 928 may be suitable to receive a conductor 602, as previously described.

In the luminaire 900, the inner body 906 may be at least partially transparent or translucent, while the outer body 904 may be at least partially colored or opaque. One or more apertures 910 may be formed in the outer body 904 such that the inner body 906 is visible. In the example shown, the inner body 906 may be recessed within the apertures 910. In other examples, the inner body 906 may include one or more surface features 106 that extend toward or are flush with the outer surface of outer body 916. The one or more apertures 910 may form windows through which light emitted by the light source 820 or the light source 606 may pass to the environment. The outer body 904 may form a lattice 912 between the one or more apertures 910 so as to form a divided light effect. The one or more apertures 910 may cause the light to form patterns, images, words, symbols or the like. A portion of the light emitted by the light source 820 or the light source 606 may pass through the aperture 914 forming a spotlight effect.

Figure 10B:
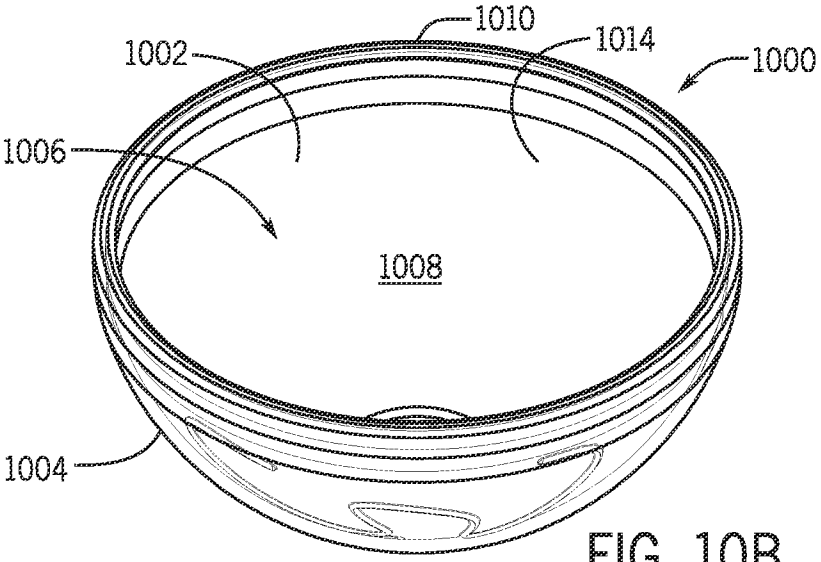
FIG. 10B is a perspective view of the three dimensional article.
Figure 10A:
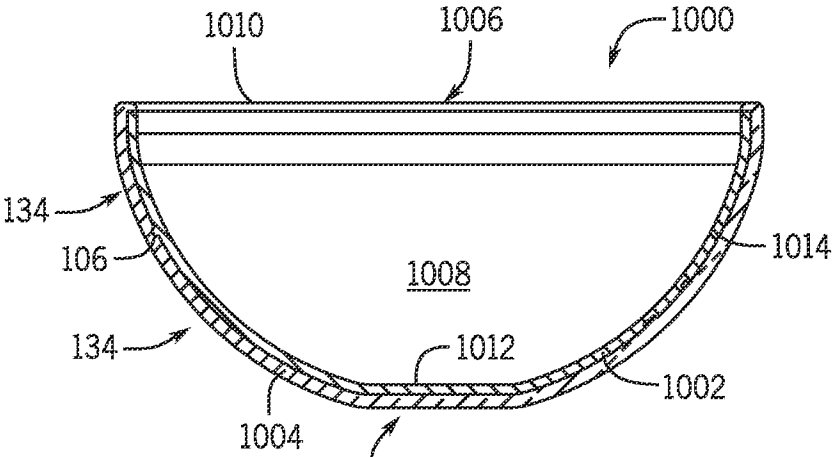
FIG. 10A is a section view of the three dimensional article of FIG. 10B taken along line 10A-10A of FIG. 10C.
Figure 10C:
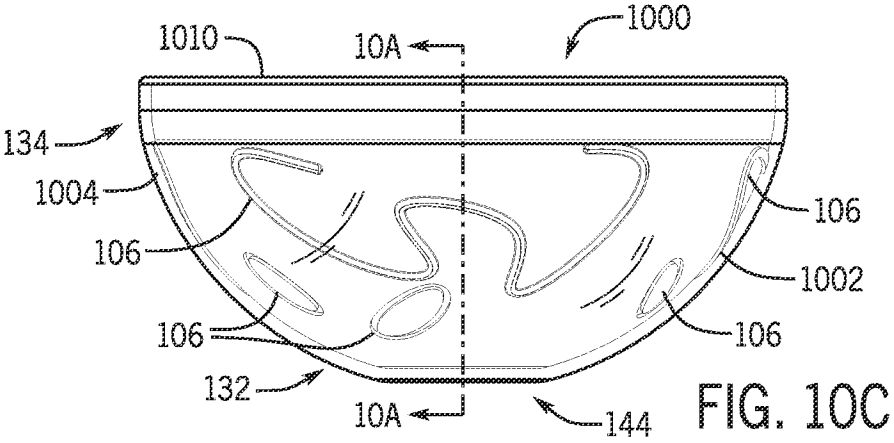
FIG. 10C is a side elevation view of the three dimensional article of FIG. 10A.

With reference to FIGS. 10A-10C a three dimensional article 1000 is disclosed. Like other three dimensional articles disclosed herein, the three dimensional article 1000 includes an inner body 1002 and an outer body 1004 that at least partially encloses the inner body 1002. The three dimensional article 1000 includes one or more surface features 106 as previously discussed. The three dimensional article 1000 includes a wide aperture 1006 formed by a rim 1010. The rim 1010 may be any rim disclosed herein. The three dimensional article 1000 may not include a neck portion. The rim 1010 may be broader than either or both of the base or the medial portions. The three dimensional article 1000 may be in the form of a bowl, pot, box, or the like. The three dimensional article 1000 may have an internal compartment 1008 suitable to receive a fluid or object. The three dimensional article 100 may have a planar face 1012 at a base end of the main body. The inner body 1002 and the outer body 1004 may form sloped or curved side walls 1014.

Figure 11A:
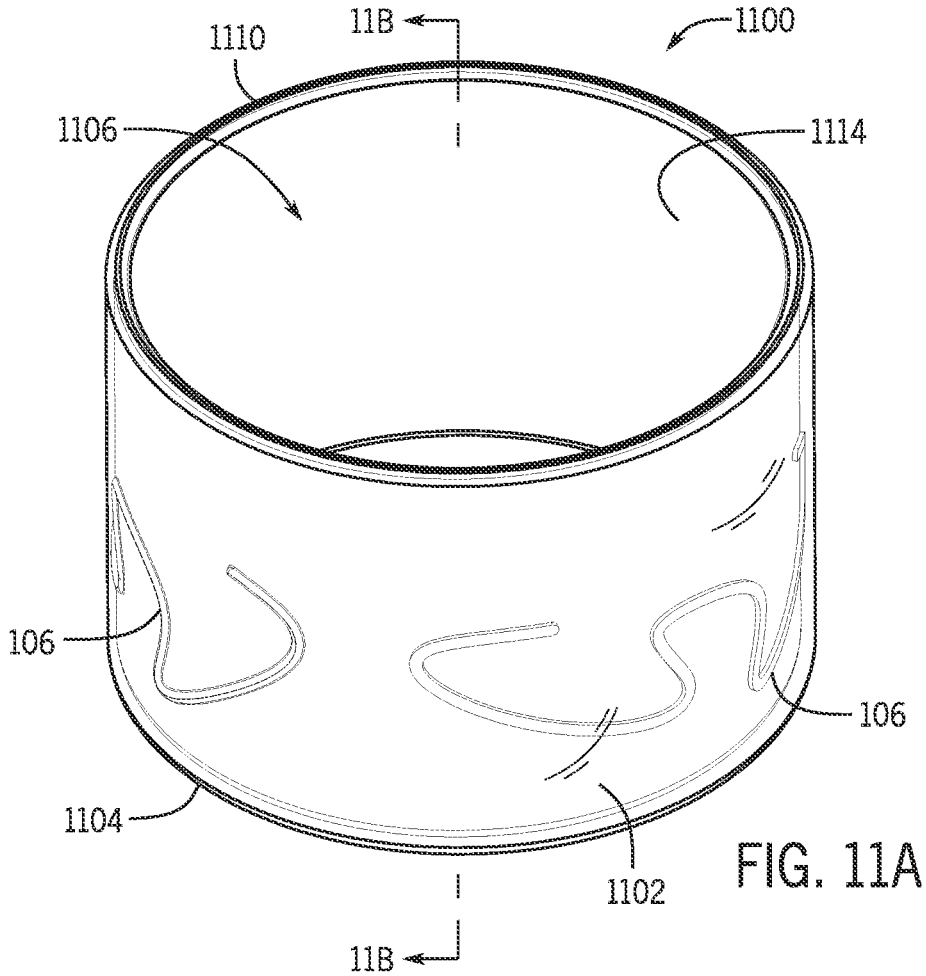
FIG. 11A is a perspective view of a three dimensional article.
Figure 11B:
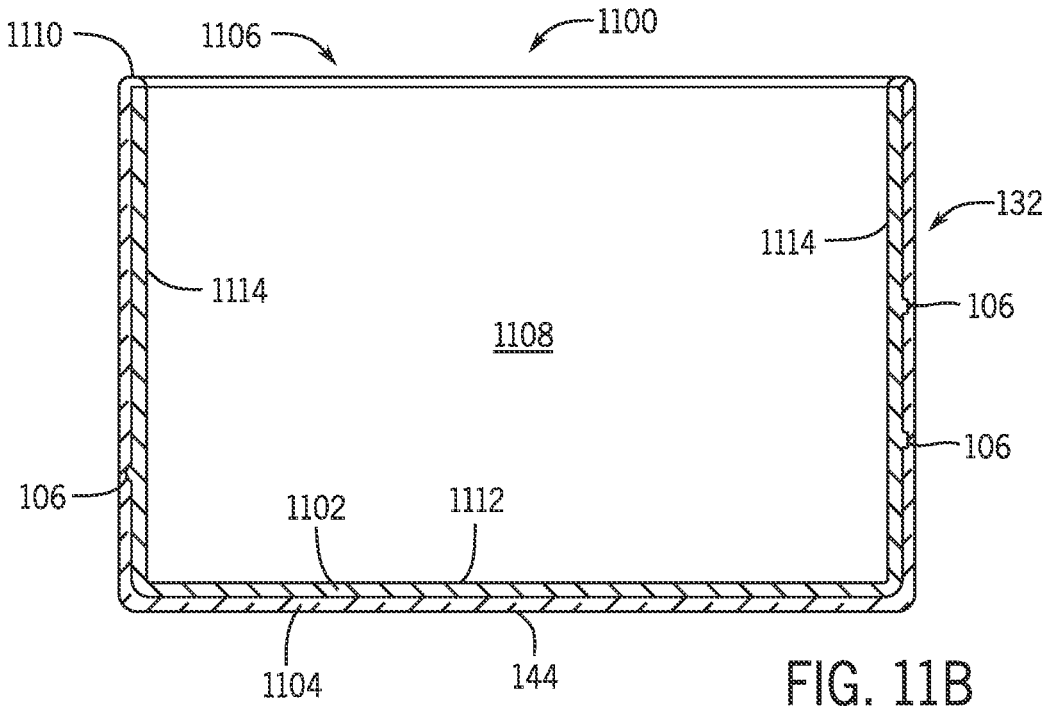
FIG. 11B is a section view of the three dimensional article of FIG. 11A taken along line 11B-11B of FIG. 11A.

With reference to FIGS. 11A-11B a three dimensional article 1100 is disclosed. Like other three dimensional articles disclosed herein, the three dimensional article 1100 includes an inner body 1102 and an outer body 1104 that at least partially encloses the inner body 1102. The three dimensional article 1100 includes one or more surface features 106 as previously discussed. The three dimensional article 1100 includes a wide aperture 1106 formed by a rim 1110. The rim 1110 may be any rim disclosed herein. The three dimensional article 1100 may not include a neck portion. The rim 1110 may be the same dimension as either or both of the base or the medial portions. The three dimensional article 1100 may be in the form of a bowl, pot, box, or the like. The three dimensional article 1100 may have an internal compartment 1108 suitable to receive a fluid or object. The inner body 1102 and the outer body 1104 may form straight or cylindrical side walls 1114. The three dimensional article 100 may have a planar face 1112 at a base end of the main body. While the example shown is substantially cylindrical in shape, other shapes may be used, such as square, rectangular, other polygons, or irregular shapes.

Figure 12A:
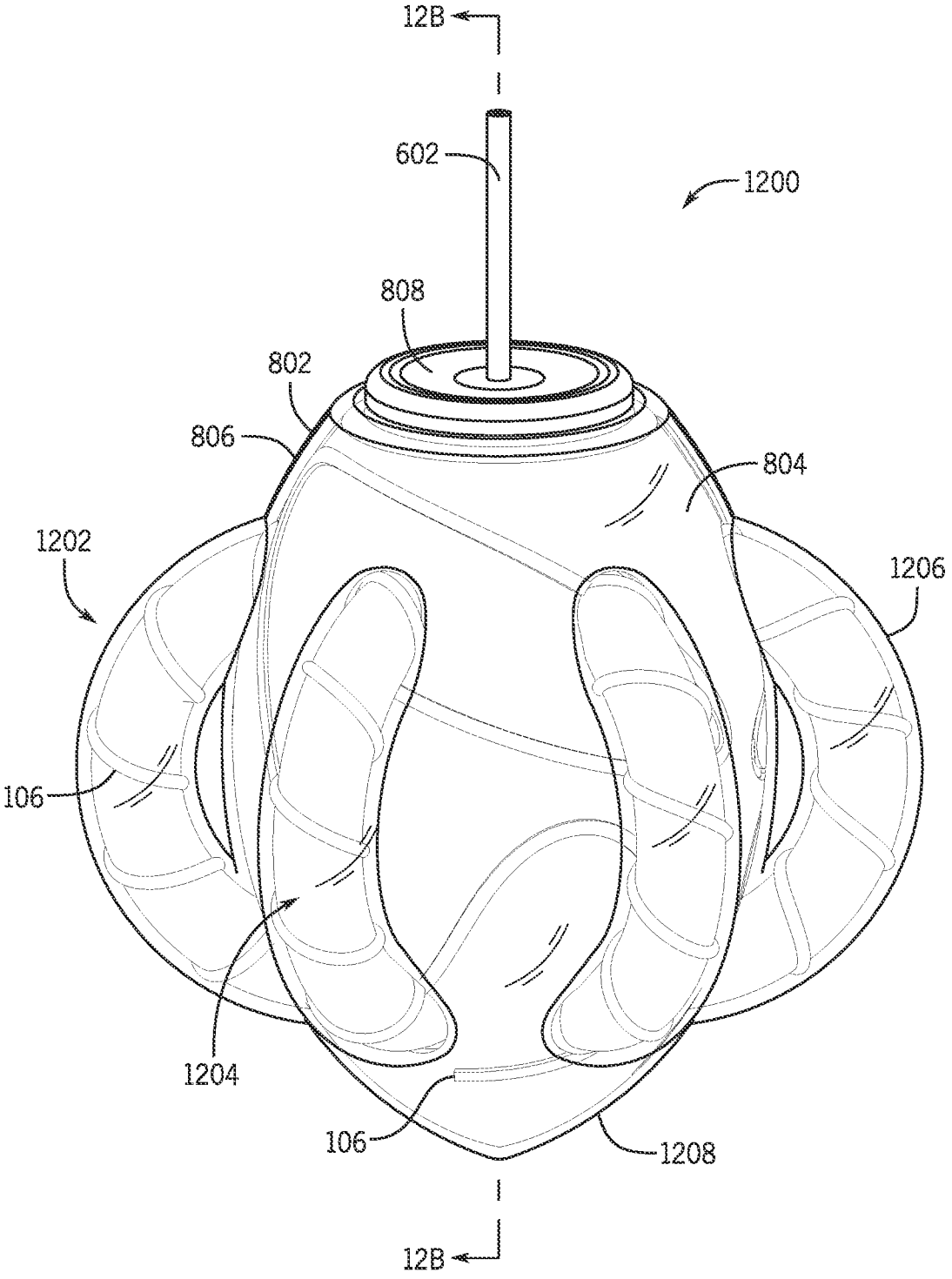
FIG. 12A is a perspective view of a luminaire.
Figure 12B:
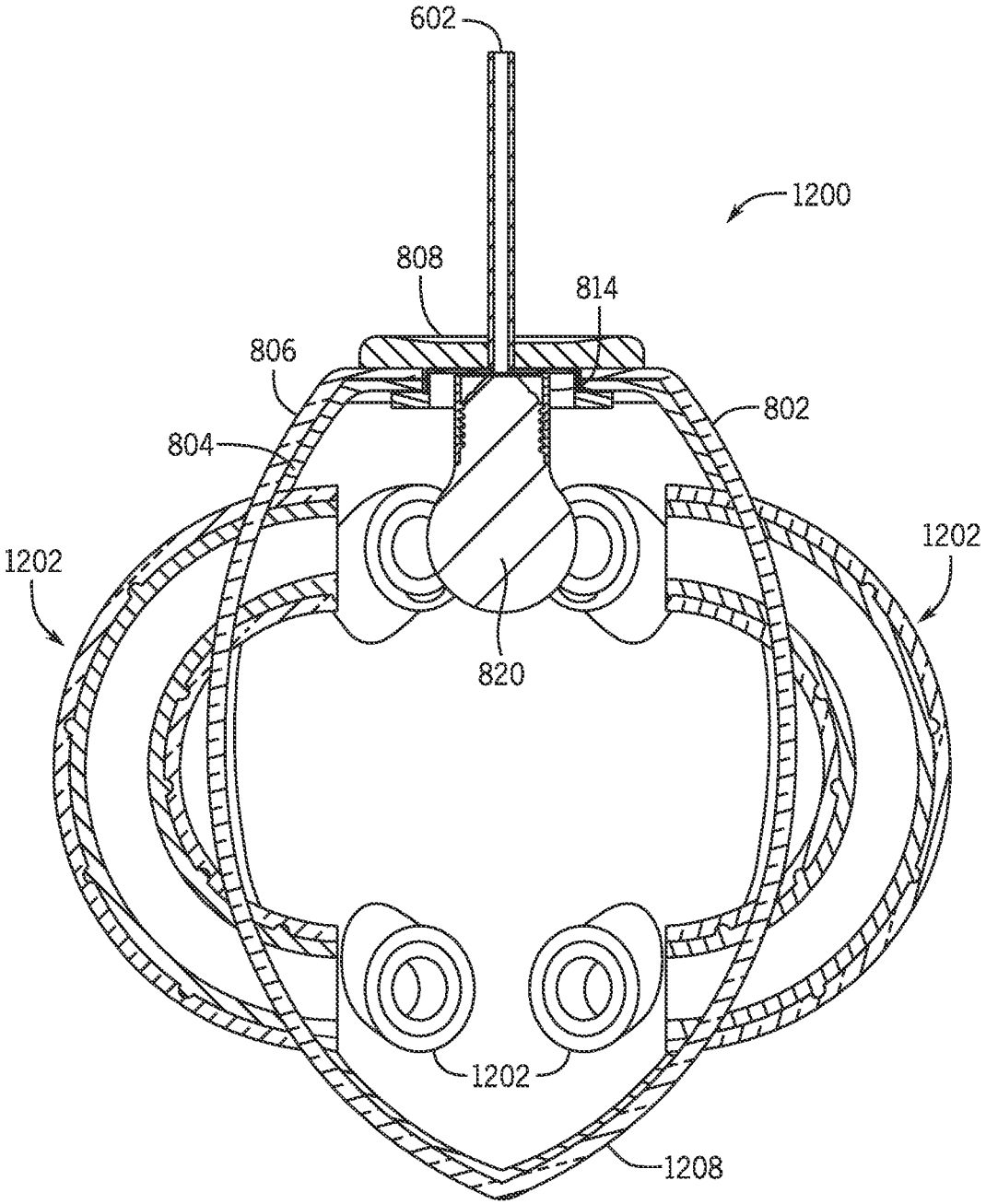
FIG. 12B is a section view of the luminaire of FIG. 12A taken along line 12B-12B of 12A.

With reference to FIGS. 12A-12B, a luminaire 1200 is disclosed. The luminaire 1200 may include a three dimensional article 802 or other three dimensional article disclosed herein. The three dimensional article 802 may have an inner body 804 and an outer body 806 that form the main body 1208 similar to the main body 832 of the luminaire 800. The luminaire 1200 may include one or more surface features 106 as previously discussed. The luminaire 1200 may include a light source 820 or a light source 606. One or more tubular portions 1202 may extend from and back to the main body 1208. The one or more tubular portions 1202 may include respective inner bodies 1204 and outer bodies 1206. The tubular portions 1202 may include one or more surface feature 106 as previously discussed. The inner body 1204 and the outer body 1206 may be extensions of the respective inner body 804 and outer body 806. The one or more tubular portions 1202 may penetrate through one or more of the inner body 804 and outer body 806. The one or more tubular portions 1202 may act as light pipes to direct a portion of the light emitted from the light source 820 or the light source 606. Thus, the one or more tubular portions 1202 may provide an aesthetic benefit of more broadly distributing light emitted from the light source 820 or the light source 606.

Figure 13:
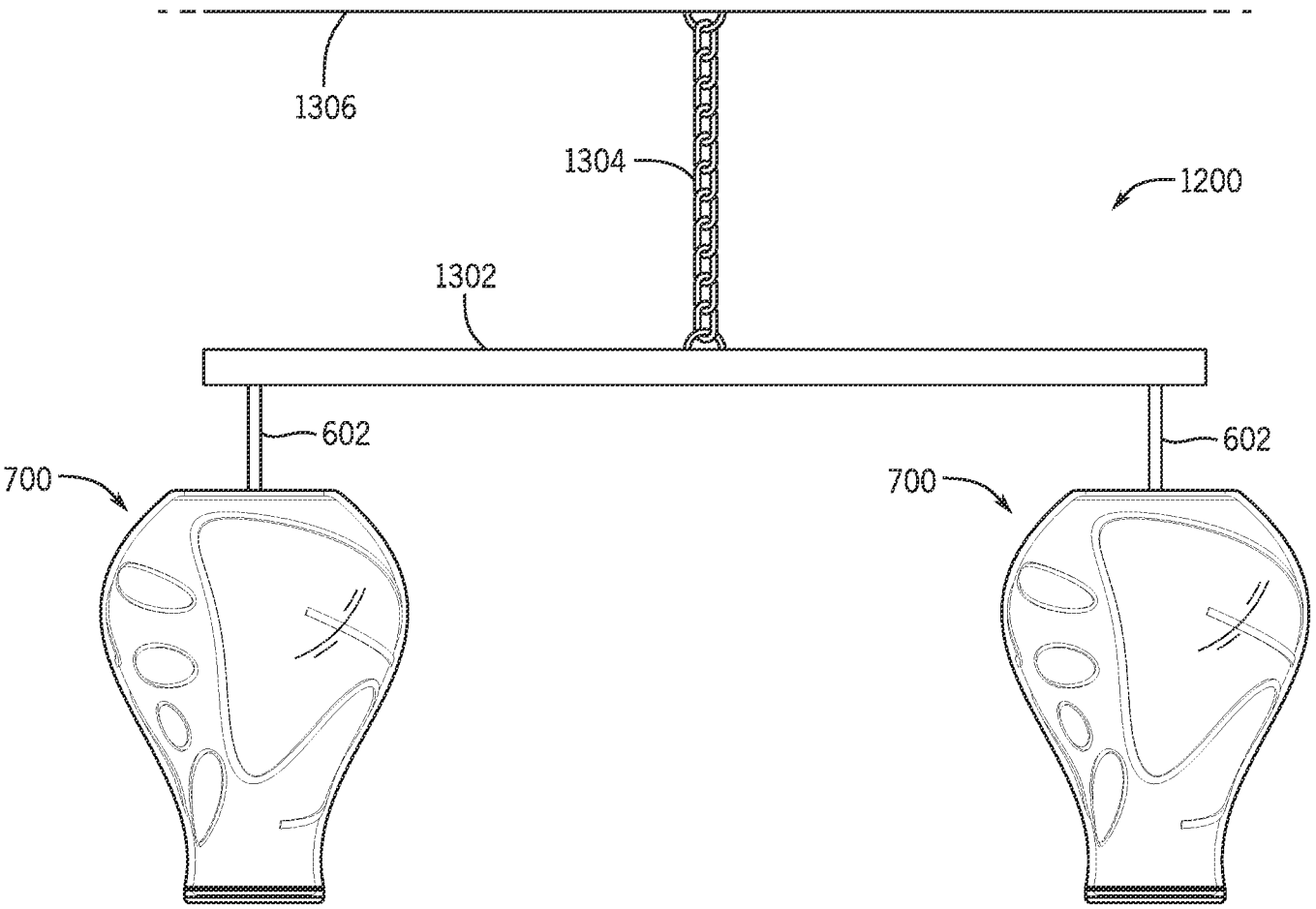
FIG. 13 is a chandelier suitable for use with any luminaire, or combination of luminaires, disclosed herein.

With reference to FIG. 13, a chandelier 1300 is disclosed. The chandelier 1300 may include one or more luminaires as disclosed herein. As shown, for example, the chandelier 1300 may include one or more luminaires 700. The chandelier 1300 may include a mix of different types of luminaires or may include all the same type of luminaire. The luminaires 700 may be suspended by respective conductors 602. The conductors 602 may be coupled to one or more lateral supports 1302. The one or more lateral supports 1302 may be coupled to one or more flexible elements 1304 that couple the chandelier 1300 to a fixture such as a ceiling 1306 or wall. The flexible element 1304 may be a chain, belt, cable, strap, or other similar element.

The description of certain embodiments included herein is merely exemplary in nature and is in no way intended to limit the scope of the disclosure or its applications or uses. In the included detailed description of embodiments of the present systems and methods, reference is made to the accompanying drawings which form a part hereof, and which are shown by way of illustration specific to embodiments in which the described systems and methods may be practiced. These embodiments are described in sufficient detail to enable those skilled in the art to practice presently disclosed systems and methods, and it is to be understood that other embodiments may be utilized, and that structural and logical changes may be made without departing from the spirit and scope of the disclosure. Moreover, for the purpose of clarity, detailed descriptions of certain features will not be discussed when they would be apparent to those with skill in the art so as not to obscure the description of embodiments of the disclosure. The included detailed description is therefore not to be taken in a limiting sense, and the scope of the disclosure is defined only by the appended claims.

From the foregoing it will be appreciated that, although specific embodiments of the invention have been described herein for purposes of illustration, various modifications may be made without deviating from the spirit and scope of the invention.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice.

As used herein and unless otherwise indicated, the terms "a" and "an" are taken to mean "one", "at least one" or "one or more". Unless otherwise required by context, singular terms used herein shall include pluralities and plural terms shall include the singular.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

Of course, it is to be appreciated that any one of the examples, embodiments or processes described herein may be combined with one or more other examples, embodiments and/or processes or be separated and/or performed amongst separate devices or device portions in accordance with the present systems, devices and methods.

Finally, the above discussion is intended to be merely illustrative of the present system and should not be construed as limiting the appended claims to any particular embodiment or group of embodiments. Thus, while the present system has been described in particular detail with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

The inner body 102 and outer body 104 used as examples herein have focused on a single inner body 102 and a single outer body 104. The adult toy of the present description and according to the instant invention may also include more than one inner body 102, each with an outer body 104, or may include more than one inner body 102 with less than all inner bodies 114 having an outer body 104.

What is claimed is:

1. A three dimensional article comprising:

a main body comprising:

an inner body;

an outer body made of an at least partially transparent silicone overlaying at least a portion of the inner body, the inner body and the outer body together defining a first thickness dimension, the main body having a rim portion defining an open aperture extending into an internal compartment having a major dimension and a minor dimension, the minor dimension being less than the major dimension;

a selectively closed aperture formed through the inner body and the outer body in a base portion and extending to the internal compartment, wherein the inner body extends into the selectively closed aperture radially inward relative to the outer body to form a lip;

a plug selectively insertable into the selectively closed aperture and engages the lip; and wherein:

at least a part of the inner body is at least partially visible through the outer body, and the major dimension and the minor dimension are both at least four times greater than the thickness dimension.

2. The three dimensional article of claim 1, wherein an outer surface of the inner body includes at least one surface feature visible through the outer body.

3. The three dimensional article of claim 1, wherein:

the main body includes a base portion, a medial portion, a neck portion, and the rim portion; wherein:

the base portion is located opposite the rim portion;

the medial portion is located between the base portion and the rim portion and has a width greater than the base portion, the neck portion, and the rim portion of the main body; and the neck portion is located between the rim portion and the medial portion and has a width less than the medial portion and the rim portion, and each of the inner body and outer body defining a base portion, medial portion, neck portion, and a rim portion corresponding to the base portion, the medial portion, the neck portion, and the rim portion of the main body.

4. The three dimensional article of claim 1, wherein:

the inner body includes an inner surface of the inner body and an outer surface of the inner body; and the outer body includes an inner surface of the outer body and an outer surface of the outer body, wherein the outer surface of the inner body and the inner surface of the outer body are joined at an interface.

5. The three dimensional article of claim 4, wherein the inner surface of the inner body forms a wall of the internal compartment.

6. The three dimensional article of claim 1, wherein:

the outer body includes an upper edge; and the inner body includes a flange that extends outward from the internal compartment toward the outer body over the upper edge of the outer body to the outer surface of the outer body to form the rim portion.

7. The three dimensional article of claim 1, wherein:

the inner body includes an upper edge;

the outer body includes a flange that extends radially inward from an outer surface of the outer body over the upper edge of the inner body to align with an inner surface of the inner body to form the rim portion; and the flange forms a shoulder and the upper edge of the inner body abuts the shoulder.

8. The three dimensional article of claim 1, wherein the inner body and the outer body include respective upper edges substantially flush with one another to form the rim portion.

9. The three dimensional article of claim 1, wherein the inner body comprises at least one surface feature integral with the inner body that extends from an outer surface of the inner body through the outer body and penetrates an outer surface of the outer body.

10. The three dimensional article of claim 9, wherein the at least one surface feature extends above the outer surface of the outer body.

11. The three dimensional article of claim 9, wherein the at least one surface feature comprises a second surface feature that extends from the outer surface of the inner body into the outer body to a depth between the inner surface of the outer body and the outer surface of the outer body.

12. The three dimensional article of claim 1, wherein:

the plug includes a gland formed on a circumferential face thereof and extending from the circumferential face towards a middle of the plug, and wherein the selectively closed aperture is adapted to receive the plug such that the gland operatively engages with the lip to removably secure the plug to the main body.

13. The three dimensional article of claim 4, wherein:

the outer surface of the inner body is patterned;

the inner surface of the outer body conforms to the outer surface of the inner body; and the outer surface of the outer body does not replicate the pattern of the outer surface of the inner body.

14. The three dimensional article of claim 13, wherein the pattern includes a plurality of ribs with scallops disposed therebetween, and a thickness of the outer body varies to fill in the scallops such that the outer surface of the outer body is smooth.

15. The three dimensional article of claim 13, wherein a combined thickness of the inner body and the outer body is substantially the same at a rib and at a scallop.

16. The three dimensional article claim 1 comprising a luminaire including a light source.

17. A container comprising:

a main body comprising:

an inner body;

a silicone outer body overlaying at least a portion of the inner body and together defining a first thickness dimension, the main body having a rim portion defining an open aperture extending to an internal compartment having a major dimension and a minor dimension, the minor dimension being less than the major dimension;

the rim portion about the open aperture defined by an upper edge of the inner body and a flange of the outer body, where the flange extends radially inwardly from an outer surface of the outer body and over the upper edge to align with an inner surface of the inner body;

a selectively closed aperture formed through the inner body and the outer body in a base portion and extending to the internal compartment, wherein the inner body extends into the selectively closed aperture radially inward relative to the outer body to form a lip; and wherein:

at least one of the inner body or the outer body is at least partially visible through the other of the inner body or the outer body, the major dimension and the minor dimension are both at least four times greater than the thickness dimension, and the main body includes a base portion, a medial portion, and the rim portion.

* * * * *